US008627543B2

(12) United States Patent
Vrdoljak et al.

(10) Patent No.: US 8,627,543 B2
(45) Date of Patent: Jan. 14, 2014

(54) CLEANING APPLIANCE HAVING MULTIPLE FUNCTIONS

(75) Inventors: Ognjen Vrdoljak, Laval (CA); Chow Hung, Tai Po (HK); Stephen Gatchell, Cordova, TN (US); Mason Isaac Greene, Auburn, AL (US); Homero Garza Malacara, Queretaro (MX)

(73) Assignee: Euro-Pro Operating LLC, Newton, MA (US)

( * ) Notice: Subject to any disclaimer, the term of this patent is extended or adjusted under 35 U.S.C. 154(b) by 864 days.

(21) Appl. No.: 12/723,609

(22) Filed: Mar. 12, 2010

(65) Prior Publication Data

US 2010/0251505 A1 Oct. 7, 2010

(51) Int. Cl.

| | |
|---|---|
| ***A47L 5/00*** | (2006.01) |
| ***A47L 9/00*** | (2006.01) |
| ***A47L 7/00*** | (2006.01) |

(52) U.S. Cl.

USPC ..... 15/338; 15/337; 15/328; 15/319; 15/320

(58) Field of Classification Search

USPC ..... 15/337, 338, 328, 319, 320

See application file for complete search history.

(56) References Cited

U.S. PATENT DOCUMENTS

| | | | | |
|---|---|---|---|---|
| 3,319,282 | A | 5/1967 | MacFarland | |
| 4,225,999 | A * | 10/1980 | Martinec et al. | 15/422.2 |
| 4,433,451 | A | 2/1984 | Parisi | |
| 4,696,074 | A | 9/1987 | Cavalli | |
| 5,587,021 | A | 12/1996 | Hoersch et al. | |
| 5,613,271 | A | 3/1997 | Thomas | |
| 6,521,849 | B1 | 2/2003 | Flegel | |
| 6,563,063 | B1 | 5/2003 | Moore | |
| 6,571,421 | B1 | 6/2003 | Sham et al. | |
| 6,584,990 | B2 | 7/2003 | Shaw | |
| 6,842,936 | B2 | 1/2005 | Policicchio et al. | |
| 6,851,158 | B2 | 2/2005 | Sclafani et al. | |
| 6,934,995 | B2 | 8/2005 | Wheeler et al. | |
| 7,137,169 | B2 | 11/2006 | Murphy et al. | |
| 7,811,022 | B2 | 10/2010 | Bobrosky et al. | |
| 8,052,342 | B2 | 11/2011 | Rosenzweig et al. | |
| 2003/0233727 | A1 | 12/2003 | Wheeler et al. | |
| 2004/0134016 | A1 | 7/2004 | Kisela et al. | |
| 2007/0124891 | A1 * | 6/2007 | Lee et al. | 15/320 |
| 2007/0130719 | A1 | 6/2007 | Zhou | |
| 2008/0066789 | A1 | 3/2008 | Rosenzweig et al. | |
| 2008/0235899 | A1 | 10/2008 | Haan | |

(Continued)

FOREIGN PATENT DOCUMENTS

| | | | |
|---|---|---|---|
| CN | 2875290 | Y | 3/2007 |
| CN | 201098085 | Y | 8/2008 |

(Continued)

OTHER PUBLICATIONS

International Preliminary Report on Patentability for PCT/US2010/000382 mailed Aug. 25, 2011.

(Continued)

*Primary Examiner* — Bryan R Muller

(74) *Attorney, Agent, or Firm* — Wolf, Greenfield & Sacks, P.C.

(57) ABSTRACT

A cleaning appliance is capable of performing two or more cleaning functions. The cleaning appliance may include a vacuum cleaner and a steam cleaner such that a user can vacuum a floor prior to steam cleaning the floor.

9 Claims, 19 Drawing Sheets

(56) References Cited

U.S. PATENT DOCUMENTS

| | | | | |
|---|---|---|---|---|
| 2008/0236635 | A1 | 10/2008 | Rosenzweig et al. | |
| 2008/0301900 | A1 | 12/2008 | Choi et al. | |
| 2009/0064447 | A1 | 3/2009 | Oh et al. | |
| 2009/0064448 | A1 | 3/2009 | Oh et al. | |
| 2009/0100631 | A1 | 4/2009 | Haan | |
| 2009/0113657 | A1 | 5/2009 | Haan | |
| 2010/0050369 | A1 | 3/2010 | Rosenzweig et al. | |
| 2010/0199455 | A1 * | 8/2010 | Vrdoljak | 15/320 |
| 2010/0236018 | A1 | 9/2010 | Vrdoljak et al. | |
| 2010/0287716 | A1 | 11/2010 | Kasper et al. | |

FOREIGN PATENT DOCUMENTS

| | | | |
|---|---|---|---|
| DE | 201 03 268 | U1 | 6/2001 |
| EP | 1 027 855 | A2 | 8/2000 |
| JP | 2006-26298 | A | 2/2006 |
| JP | 2006-130050 | A | 5/2006 |
| KR | 10-0194380 | B1 | 6/1999 |
| KR | 10-0470320 | B1 | 3/2005 |
| KR | 10-2007-0027895 | A | 3/2007 |
| KR | 10-2007-0058802 | A | 6/2007 |
| KR | 10-2007-0058837 | A | 6/2007 |
| KR | 10-0738478 | B1 | 7/2007 |
| KR | 10-2007-0081662 | A | 8/2007 |
| KR | 10-2007-0103608 | A | 10/2007 |
| KR | 10-2008-0061768 | A | 7/2008 |
| KR | 10-2008-0107048 | A | 12/2008 |
| WO | WO 01/54555 | A1 | 8/2001 |
| WO | WO 2005/011461 | A1 | 2/2005 |
| WO | WO 2008/096949 | A1 | 8/2008 |

OTHER PUBLICATIONS

International Search Report and Written Opinion for PCT/US2011/027492 mailed Dec. 28, 2011.

Chinese Office Action for CN 201010250536.0 mailed Jun. 29, 2012.

International Search Report and Written Opinion for PCT/US2010/044505 mailed Apr. 8, 2011.

Chinese Office Action and Search Report for CN 201010250568.0 mailed Apr. 9, 2013.

International Search Report and Written Opinion for PCT/US2010/000382 mailed Jun. 18, 2010.

International Preliminary Report on Patentability for PCT/US2010/044505 mailed Feb. 16, 2012.

International Preliminary Report on Patentability for PCT/US2011/027492 mailed Sep. 27, 2012.

* cited by examiner

CLEANING APPLIANCE HAVING MULTIPLE FUNCTIONS

FIELD OF THE INVENTION

The invention relates generally to cleaning appliances having two or more cleaning functions, and more specifically to cleaning appliances which vacuum surfaces and apply steam to surfaces.

DISCUSSION OF RELATED ART

Steam cleaning devices such as steam mops are known to sanitize floors by applying steam through a material such as a steam-permeable fabric. The steam-permeable fabric to additionally may clean the floor by picking up dust, dirt or other debris as the steam mop is moved across the floor. If large amounts of such particles are present, the fabric may become soiled quickly and require frequent cleaning. Accordingly, a floor may be prepared for steam cleaning by sweeping or vacuuming the floor.

SUMMARY

Embodiments of the invention provided herein are directed to cleaning appliances, methods and systems in which one cleaning appliance is capable of performing two or more cleaning functions. For example, a cleaning appliance may include a suction function and a steam function for cleaning and sanitizing floors or other surfaces. In some embodiments, each function is operated separately, while in other embodiments, two or more functions may be performed simultaneously. Various switching arrangements, control arrangements, and/or component configurations may used to control operation of the cleaning functions.

According to one embodiment of the invention, a cleaning appliance comprises an appliance body including a debris inlet in communication with an air flow passage, a source to generate steam, a steam outlet in communication with a steam conduit, the steam conduit being in communication with the steam generation source, and an obstruction element configured to selectively obstruct at least one of the debris inlet and the air flow passage to prevent steam from moving through the air flow passage past the obstruction element.

According to another embodiment of the invention, a cleaning appliance capable of performing at least two different cleaning functions includes a housing, a cleaning head, a controller configured to control operation of a first cleaning function and a second cleaning function, and a component selectively attachable to the cleaning appliance. When the selectively attachable component is not attached to the cleaning appliance, the controller is capable of operating the cleaning appliance to perform the first cleaning function, and when the selectively attachable component is attached to the cleaning appliance, the controller is capable of operating the cleaning appliance to perform the second cleaning function.

According to a further embodiment of the invention, a cleaning appliance includes a to source to generate steam, a cleaning head having a steam outlet in communication with the steam generation source, the cleaning head further including an alignment feature. The cleaning appliance further includes a selectively attachable support for a cleaning pad, the support including an alignment feature which is complementary to the alignment feature of the cleaning head to guide the attachable support into alignment with the cleaning head when the cleaning head and the attachable support are moved toward one another.

According to another embodiment of the invention, a cleaning appliance includes a floor cleaning head, a user handle connectable to the floor cleaning head through a pole and/or a component housing, and a selectively removable pad support that is attachable to a floor-facing side of the floor cleaning head. The selectively removable pad support includes a step portion which extends laterally from the floor cleaning head such that an upper side of the step portion is accessible to a portion of a user's foot. The selectively removable pad support and the floor cleaning head are constructed and arranged such that pulling the floor cleaning head upwardly while a user steps on the step portion removes the pad support from the floor cleaning head.

According to a further embodiment of the invention a method of attaching and removing a selectively removable pad support from a cleaning head of a cleaning appliance includes acts of placing a selectively removable pad support on a floor, moving a cleaning head of a cleaning appliance downwardly onto an upper side of the pad support such that a floor-facing side of the cleaning head engages with the pad support, and cleaning the floor with the cleaning appliance with the pad support on the cleaning head. The method further includes stepping on a step portion of the pad support which extends laterally from the underside of the cleaning head, and pulling upwardly on the cleaning head to remove the pad support from the cleaning head.

According to yet another embodiment of the invention, a cleaning appliance includes a suction opening in communication with an air flow passage, the air flow passage being configured to communicate with a source to generate suction, and a steam outlet in communication with a steam conduit, the steam conduit being configured to communicate with a source to generate steam to create a steam path from the steam outlet. The cleaning appliance further includes a steam-permeable fabric, and a selectively removable support configured to hold the steam-permeable fabric such that the steam-permeable fabric intersects the steam path and steam permeates the steam-permeable fabric when steam is emitted from the steam outlet.

According to another embodiment of the invention, a cleaning appliance comprises an appliance body including a first cleaning function source operative upon energization, and a second cleaning function source operative upon energization. The cleaning appliance also comprises a control system for the appliance body including a first switch having an on mode and an off mode, the first switch being required to be in the on mode for the first cleaning function source to be energized, and a second switch having an on mode and an off mode, the second switch being required to be in the on mode for the second cleaning function source to be energized. Also included is a movable cover having first and second positions, wherein in the first position, the cover prevents access to the first switch and permits access to the second switch, and wherein in the second position, the cover prevents access to the second switch and permits access to the first switch. Moving the cover from the first position to the second position switches the second switch to the off mode.

According to a further embodiment of the invention, a cleaning appliance comprises a housing, a cleaning head, a first cleaning function source operative upon energization, a second cleaning function source operative upon energization, a first switch having a first mode and a second mode, and a second switch having a first mode and a second mode, the second switch being constructed and arranged such that attachment of a selectively attachable cleaning component to the cleaning appliance causes the second switch to change from the first mode to the second mode. The first switch is required to be in the second mode and the second switch is required to be in the second mode for the first cleaning function source to be energized.

According to yet another embodiment of the invention, a cleaning head for a vacuum appliance is provided, with the cleaning head being movable in at least a first direction. The cleaning head includes a housing including a floor-facing surface, and a suction opening in the floor-facing surface, the suction opening being in communication with an air flow passage, the air flow passage being configured to communicate with a source to generate suction. The suction opening has a perimeter, and a portion of the perimeter extends downwardly from the floor-facing surface farther than other portions of the perimeter to form a debris catch, the debris catch being positioned to be transverse the first direction of movement.

According to a further embodiment of the invention, a cleaning head for a vacuum appliance includes a floor-facing surface having a front, a rear, and two sides, a suction opening, and a recessed portion of the floor-facing surface in communication with the suction opening, the recessed portion having first, second and third widths in a side-to-side direction of the floor-facing surface. The first width is located closer to the front of the floor-facing surface than the second and third widths, the third width is located closer to the rear of the floor-facing surface than the first and second widths, and the second width is located between the first and third widths in a front-to-rear direction of the floor-facing surface. The first and third widths are wider than the second width.

BRIEF DESCRIPTION OF DRAWINGS

The accompanying drawings are not intended to be drawn to scale. For purposes of clarity, not every component may be labeled in every drawing. In the drawings.

DETAILED DESCRIPTION

Figure 1:
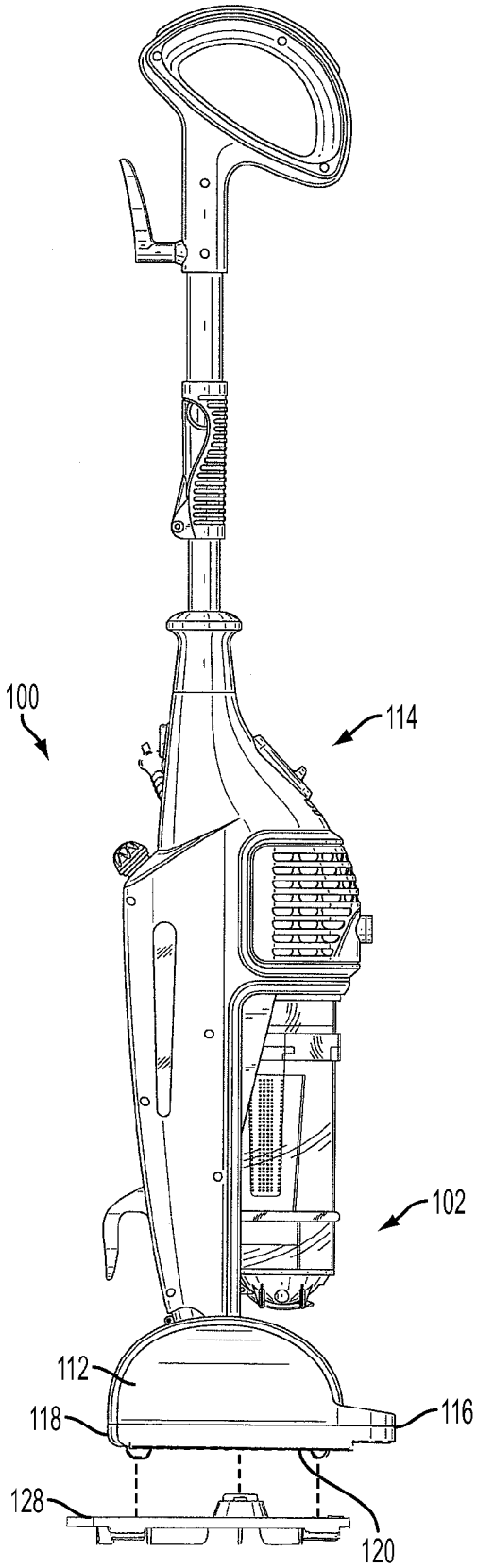
FIG. 1 is a side view of an appliance having multiple cleaning functions according to one embodiment of the invention.

It should be understood that aspects of the invention are described herein with reference to the figures, which show illustrative embodiments in accordance with aspects of the invention. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Embodiments of the invention provided herein are directed to cleaning appliance systems which are capable of cleaning floors and/or other surfaces. Examples of surface cleaners include steam mops, portable steam cleaners, vacuum cleaners, and floor sweepers, among others.

When a steam mop is used to clean a floor, a user typically first vacuums or sweeps the floor to remove dirt, dust and other debris. To reduce the number of appliances, time and effort used to complete these activities, the functionalities of debris removal and steam cleaning are combined in a single cleaning appliance according to some embodiments disclosed herein. When debris removal and steam cleaning are provided on a single cleaning appliance, simultaneous operation of both functions may be undesirable because in some cases moisture could travel into an air flow conduit or a dirt collector and form grime or mud with the collected debris. The resulting mess could reduce the effectiveness and convenience of the appliance.

According to one aspect of the invention, a selectively removable attachment is provided for a cleaning appliance which has steam cleaning and debris removal functionality. During steam cleaning, the attachment may be positioned to physically prevent steam from entering a debris inlet and traveling along an air flow conduit. In some embodiments, the attachment may be attached to a cleaning head and protect substantially the entire underside of the cleaning head from steam contact such that air flow channels present on the floor-facing surface of the cleaning head do not become moist.

According to another aspect of the invention, to prevent the passage of steam, an obstruction may be selectively implemented to obstruct an air flow conduit or debris inlet. For example, a valve may be provided to selectively block the air flow conduit, or a sliding door may be provided to selectively block the debris inlet.

Instead of, or in addition to, physically blocking the debris inlet to an air flow conduit, the cleaning appliance may include a control arrangement which prevents the debris removal portion of the appliance from operating when a selectively attachable component, such as a cleaning pad support, is attached to the appliance. For example, a switch having two modes may be provided in the cleaning head, and an element in the selectively removable attachment changes the mode of the switch when the attachment is secured to the cleaning head.

In an embodiment including a steam cleaning function and a debris removal function such as vacuuming, the presence of the attachment and its associated element may change the cleaning head switch to a steam mode which permits operation of a steam cleaner and prevents operation of a vacuum cleaner. When the attachment is removed, the lack of the element may change the cleaning head switch to a vacuum mode, enabling operation of the vacuum cleaner and preventing operation of the steam cleaner.

A manual switching arrangement also may be used to control the operation of two or more functionalities in a cleaning appliance. For example, in some embodiments, a separate on/off switch is provided for each of a first cleaning function and a second cleaning function. The two on/off switches are positioned adjacent one another, and a switch cover is movable to cover one of the two on/off switches. As the switch cover moves from covering a first on/off switch to covering a second on/off switch, the switch cover forcibly turns off the second switch. In this manner, when changing from the first cleaning function to the second cleaning function, both on/off switches cannot simultaneously be in the "on" position. Additionally, the switching arrangement may be similarly configured such that as the switch cover moves from covering the second on/off switch to covering the first on/off switch, the switch cover forcibly turns off the first on/off switch. Accordingly, in some embodiments the two switches cannot both be in the "on" position and the two cleaning functions cannot operate simultaneously.

According to another aspect of the invention, the selectively removable attachment may be configured to support a cleaning pad. The cleaning pad may be selectively removable from the attachment, and may be used to wipe dust and dirt from the surfaces being cleaned. In some embodiments, the cleaning pad is formed with a steam-permeable fabric such that steam travels through the pad before reaching the floor or other surface to be cleaned.

A selectively removable attachment, such as a cleaning pad support, may be attached and/or removed from the cleaning head without the user having to bend down to the level of the cleaning head. For example, the cleaning pad support may have one or more guide elements which help guide the cleaning pad support into a seated attachment with the cleaning head. In some embodiments, the cleaning pad support has one or more features which correspond to complementary features positioned on the floor-facing side of the cleaning head. The features help guide the cleaning pad support into alignment with the cleaning head, and magnets or other attachment elements secure the cleaning pad support to the cleaning head. In this manner, with an upright cleaning appliance, the user can remain standing while lifting or tilting the cleaning appliance and placing the cleaning appliance on the cleaning pad support. To permit removal of the cleaning pad support without bending, a step portion may extend outwardly from the cleaning pad support such that an upper side of the step portion is exposed for a user to step on. While stepping on the step portion, the user lifts the cleaning head upwardly, and the cleaning pad support disengages from the cleaning head.

Figure 2:
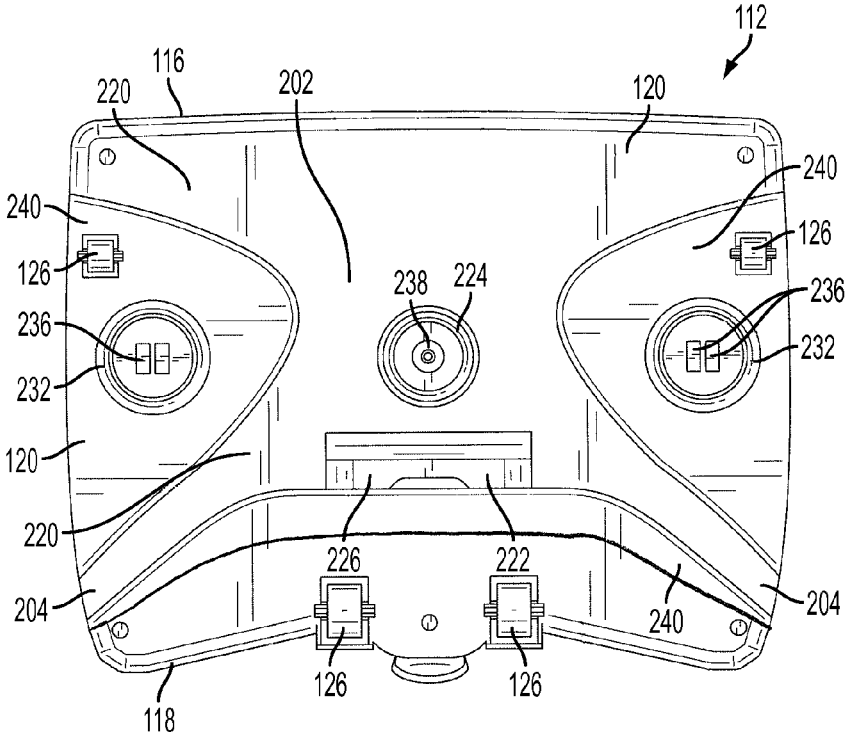
FIG. 2 is a plan view of a floor-facing side of a cleaning head according to one embodiment.

Referring to FIGS. 1 and 2, a cleaning appliance 100 includes a steam cleaner and a vacuum cleaner in a single appliance. A floor cleaning head 112 is pivotally mounted to an upright section 114. As shown, floor cleaning head 112 has a front end 116, a rear end 118 and a floor-facing surface 120. A suction opening 222 and a steam conduit 224 are provided in the floor-facing surface of floor cleaning head 112. Wheels 126, glide members or other conveyance members may be provided to permit floor cleaning head 112 to travel over the floor that is to be cleaned. In some embodiments, floor cleaning head 112 may include a brush member, such as a rotating brush. Particular components of the steam cleaner and the vacuum cleaner, as present in some embodiments, are described further below with reference to FIGS. 11-17.

Cleaning appliance 100 may be used to vacuum a floor prior to steam cleaning. The vacuum function of cleaning appliance 100 is operated to suction dirt, dust and/or other debris into suction opening 222, through an air flow conduit 226 and into a dirt collection container 102. Once vacuuming is complete, the cleaning appliance may be switched to a steam cleaning mode by attaching an additional component to cleaning appliance 100.

A selectively removable attachment, such as a cleaning pad support 128, is shown removed from cleaning appliance 100 in FIG. 1. When cleaning appliance 100 is used for steam cleaning, cleaning pad support 128 is attached to floor cleaning head 112, and steam is conducted from steam conduit 224 through to an underside of cleaning pad support 128. A cleaning pad, such as a steam pad made of steam-permeable fabric (see FIG. 6) may be attached to cleaning pad support 128 such that steam may be applied to the floor through the steam pad. In some embodiments, steam pad and cleaning pad support 128 form a steam chamber in which steam is distributed before exiting the chamber.

Floor cleaning head 112 may vacuum dust, dirt and other debris from an area larger than suction opening 122. For example, as shown in FIG. 2, floor-facing surface 120 of floor cleaning head 112 includes a recessed surface 220 forming a suction channel 202 which guides air flow toward suction opening 222, thereby channeling debris from across the lateral extent of front end 116 toward suction opening 222. Recessed surface 220 also forms suction channels 204 which open onto the sides of floor cleaning head 112 so that debris that is found to the side of floor cleaning head 112 can be captured. A narrow suction channel 204 helps to concentrate air flow in some embodiments to increase suction. Recessed surface 220 may be recessed from adjacent areas 240 of floor-facing surface 120 by a distance of 4 mm, although other distances may be used.

The particular embodiment of a floor cleaning head shown in FIG. 2, and in particular a floor cleaning head having a suction opening, is but one example of a type of floor cleaning head that may be used with embodiments disclosed herein. In some embodiments, a suction opening may be positioned at or toward the front of the floor cleaning head. Multiple suction openings may be provided, and one or more suction openings may extend across most or all of the lateral extent of the floor cleaning head. In some embodiments, no suctions channels may be present, while in other embodiments, suction channels different than the ones shown and described may be included. Further still, instead of a suction opening, an air flow opening may be provided, through which air and debris is moved by a rotating sweeper brush.

Figure 3A:
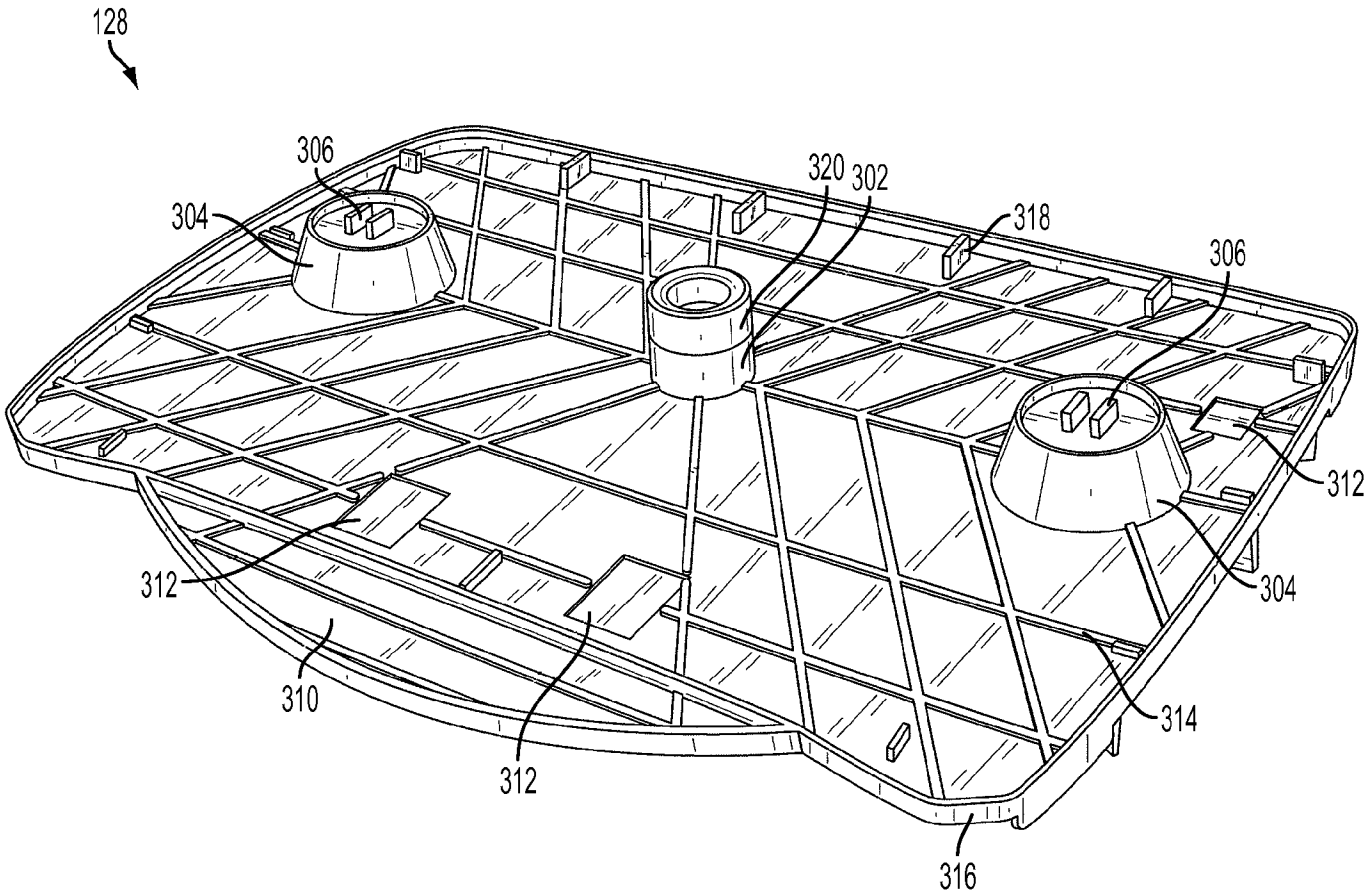
FIG. 3*a* is a top, rear perspective view of a selectively removable attachment for a cleaning head according to one embodiment.
Figure 4:
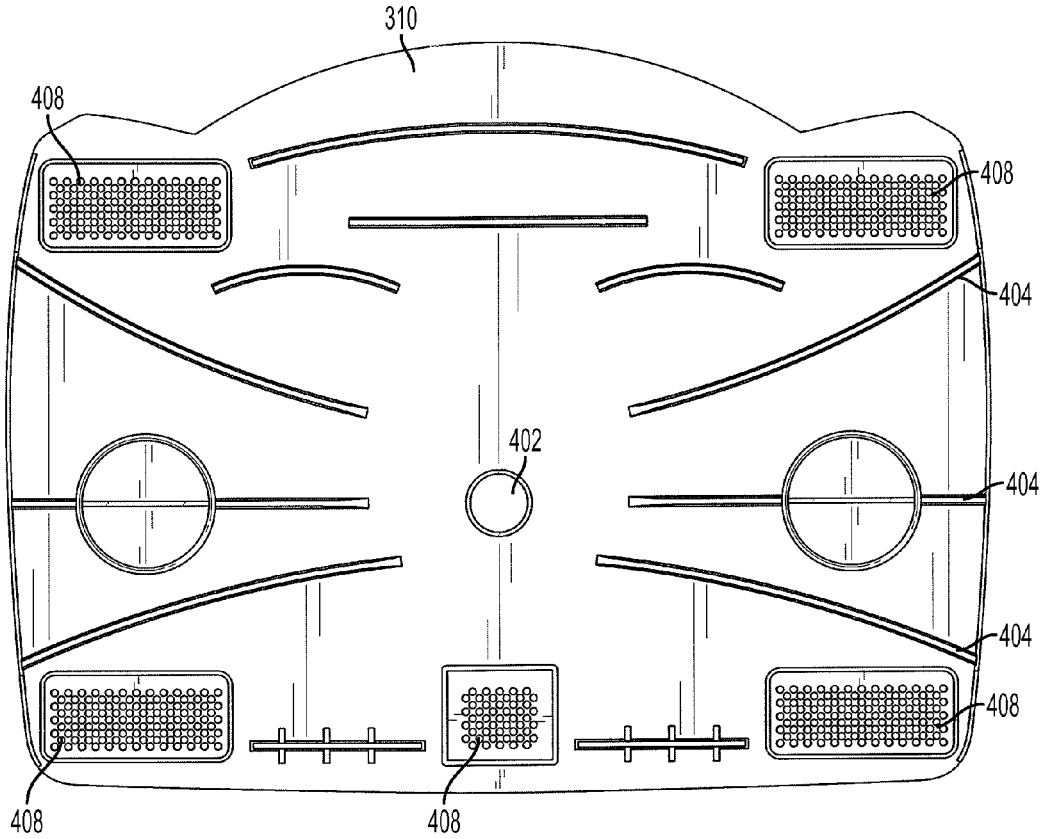
FIG. 4 is a bottom plan view of the selectively removable attachment of FIG. 3*a;*
Figure 5:
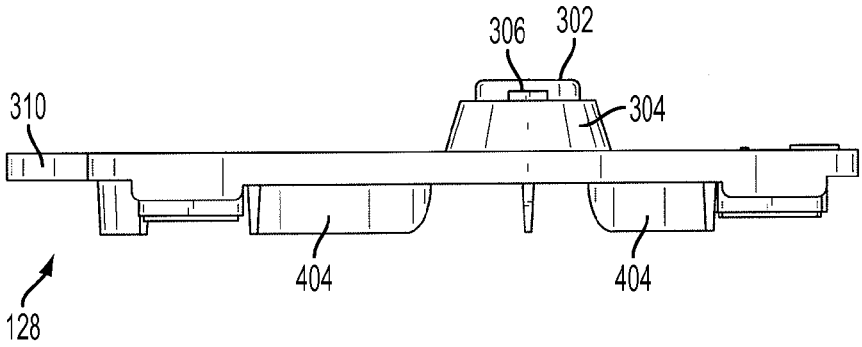
FIG. 5 is a left side elevation view of the selectively removable attachment of FIG. 3*a;*

One embodiment of cleaning pad support 128 is shown in FIGS. 3*a*, 4 and 5. A steam conduit 302 is positioned on cleaning pad support 128 to interface with steam conduit 224 of floor cleaning head 112 in a sealing arrangement. Steam conduit 302 leads to a steam outlet 402 on the underside of cleaning pad support 128. Steam is emitted from steam outlet 402 in a direction perpendicular to cleaning pad support 128. When a steam pad is attached to cleaning pad support 128, the steam pad intersects the flow of steam and redirects a portion of the steam laterally toward the sides, front and rear of cleaning pad support 128. Various walls 404 or other flow guides may be positioned to distribute the steam across the upper side of the steam pad. Steam permeates the steam-permeable fabric of the steam pad and helps clean and/or sanitize the floor or other surface over which the steam pad is being moved. Walls 404 also help to maintain separation between the steam pad and the body of cleaning pad support 128 so that steam can flow throughout the volume created between the cleaning pad and the pad support.

Figure 3B:
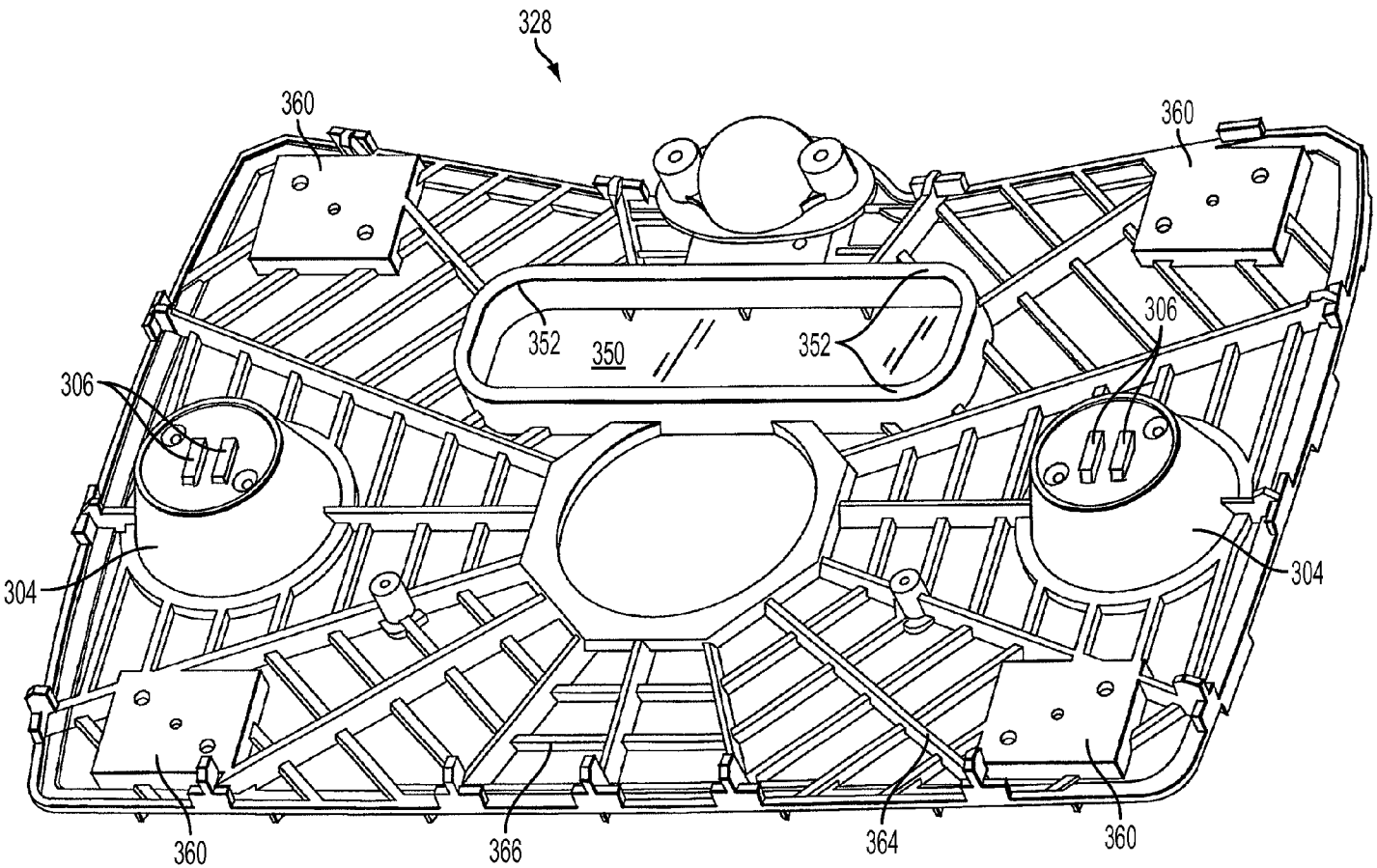
FIG. 3*b* is a top, front perspective view of another embodiment of a electively removable attachment for a cleaning head.

Cleaning pad support 128 additionally blocks suction opening 222 so that the steam being released by the steam cleaner does not enter the air flow conduit. In the embodiment illustrated in FIG. 3*a*, cleaning pad support 128 blocks suction opening 222 by covering the entire floor-facing surface of floor cleaning head 112, or in some embodiments, substantially the entire floor-facing surface of floor cleaning head 112. In some embodiments, such as an alternative embodiment of a cleaning pad support 328 illustrated in FIG. 3*b*, the cleaning pad support may not block the entirety of the floor-facing surface, but instead may cover only suction opening 222 and its immediately surrounding area. For example, a seal (not shown) may be positioned around suction opening 222 on floor cleaning head 112, and cleaning pad support 328 may have a cover member 350 with a raised wall 352 on its upper surface. Raised wall 352 presses into the seal when cleaning pad support 328 is attached to floor cleaning head 112. By using only a portion of cleaning pad support 328 to cover suction opening 222, an attached steam pad may form a steam chamber with the floor-facing surface 220 of floor cleaning head 112. Cleaning pad support 328 has a grill structure that includes a web-like pattern of radially extending baffles 364 and associated cross-pieces 366.

In still further embodiments, a sealing pad, such as a silicone or plastic pad, may be positioned on cleaning pad support 128 such that when cleaning pad support 128 is mounted to floor cleaning head 112, the pad seals against suction opening 222. Further, a hinged door or a sliding door may be positioned at suction opening 222, with the door being closed during steam operation, and open during vacuum operation.

In the embodiment illustrated in FIG. 3*a*, steam conduit 302 has a rubber seal 320 positioned at its end to abut a flat surface 238 (e.g., a brass nozzle) located in steam opening 224 (see FIG. 2). In other embodiments, one or more o-rings or other type of seal may be attached to conduit 302 to create a seal with steam conduit 224.

Instead of, or in addition to blocking suction opening 222, the air flow conduit between suction opening 222 and the dirt collection assembly may be blocked during steam operation. For example, a butterfly valve, a flapper valve, or any other suitable selectively closeable blocking element may be positioned in the air flow conduit to selectively block the conduit.

Cleaning pad support 128 may be formed with any suitable material and by any suitable method of manufacturing. In some embodiments, cleaning pad support 128 is formed with injection-molded polypropylene with glass filler. Other plastic or plastic-based materials, or any suitable material(s) may be used.

Attachment areas 408 are provided at various locations on cleaning pad support 128 to hold the selectively removable cleaning pad. The attachment areas may include hook or loop material for attachment to corresponding loop or hook material on the pad. Attachment areas may include attachment element holders, such as attachment element holders 360 shown in FIG. 3*b*. Attachment elements such as hook or loop pads may be attached to attachment element holders 360 with fasteners such as screws or the like. Of course, other attachment arrangements are possible, including tie or elastic arrangements, as the particular method of attaching a cleaning pad or steam pad to cleaning pad support 128 is not intended to be limiting.

In some embodiments, a steam outlet may include a manifold having a plurality of openings for distributing steam in different areas of cleaning pad support 128. Further, a selectively removable attachment other than a cleaning pad support may be used to distribute steam in some embodiments. For example, a removable attachment which does not support a pad may be provided on floor cleaning head 112, and steam may be applied directly to the floor from one or more steam outlets.

Alignment, seating and attachment features are provided on cleaning pad support 128 to aid in attaching cleaning pad support 128 to floor cleaning head 112. In the embodiments shown in FIGS. 3*a*, 3*b*, 4 and 5, two frustoconical protrusions 304 are spaced to either side of steam conduit 302. With cleaning pad support 128 placed on the floor, protrusions 304 extend upwardly, and corresponding frustoconical recesses 232 in floor cleaning head 112 can be lowered over protrusions 304. Because upper portions of protrusions 304 are smaller in diameter than bottoms of recesses 232, protrusions 304 and recesses 232 are not required to be precisely aligned upon initial engagement. As floor cleaning head 112 is lowered further onto protrusions 304, the corresponding outer surfaces of protrusions 304 and recesses 232 guide the floor cleaning head 112 into alignment with cleaning pad support 128. Of course, the frustoconical protrusions and recesses are but one example of arrangements for aligning floor cleaning head 112 and cleaning pad support 128, and other suitable arrangements may be employed, including magnets or protrusions of various shapes. In some embodiments, protrusions may be provided on floor cleaning head 112, and corresponding recesses may be provided on cleaning pad support 128. Recesses 232 may be conical in some embodiments.

An attachment feature may be included in the alignment features according to one aspect of the invention. For example, magnet fins 306 extend out of an upper surface of protrusions 304, and are positioned to hold to corresponding steel plates 236 provided in recesses 232. The magnetic material may take different forms and be incorporated within the alignment feature or constitute the alignment feature, as should be apparent to one of skill in the art. Other attachment arrangements may be used to attach cleaning pad support 128 to floor cleaning head 112. For example, a hook and loop fastener arrangement may be used. In still other embodiments, attachment arrangements may be used which require a user to crouch down to the level of the floor cleaning head 112 to attach and/or remove a selectively removable attachment such as a cleaning pad support.

By using magnets to attach cleaning pad support 128 to floor cleaning head 112, attachment and removal of the cleaning pad support 128 does not require numerous actions on the part of the user. To attach the cleaning pad support 128 to floor cleaning head 112, as described above, the user simply lowers the cleaning appliance onto cleaning pad support 128 either by tilting the cleaning appliance onto cleaning pad support 128, or by picking up the cleaning appliance and placing it onto cleaning pad support 128. To remove cleaning pad support 128, the user steps on a step portion 310 with her toes or other portion of her foot to restrain cleaning pad support 128, and applies an upward force on the cleaning head to separate the two components, either by tilting the cleaning appliance or by pulling upwardly on the cleaning appliance.

One or both of the magnets 306 provided in alignment features 304 may be used as part of a control configuration where presence of the magnet near to the cleaning head changes a switch from a first mode to a second mode. For example, a magnetic reed switch (not shown) may be positioned within floor cleaning head 112 such that one of magnetic fins 306 changes the reed switch's mode from a first mode to second mode. With cleaning pad support 128 attached to cleaning appliance 100, which puts the reed switch in the second mode, a cleaning function such as steam cleaning, may be permitted to be operated. Placing the reed switch in the second mode does not necessarily actuate steam cleaning, but instead places the controls into a state where activation of steam cleaning is permitted, for example by turning a manual switch to an "on" position.

The presence of magnets 306 near the reed switch also may place the controls into a state where activation of another function, such as vacuuming, is not permitted. In some embodiments, attaching cleaning pad support 128 to floor cleaning head 112 automatically turns off the vacuum function if the vacuum cleaner is operating. Alternative components may be used instead of a reed switch to register the presence of magnets 306 or other elements which indicate attachment of the selectively removable attachment. For example, a hall effect sensor may be positioned in the floor cleaning head 112 to sense the presence of magnets 306.

Other features which may be included on cleaning pad support 128 include recesses, such as shallow rectangular recesses 312, which are configured to accept wheels 126 of floor cleaning head 112. Support ribs 314 may be provided in various arrangements on cleaning pad support 128 to help maintain the support in a planar configuration. An upwardly extending lip 316 positioned around the perimeter of cleaning pad support 128 helps prevent steam from entering the area between the floor-facing surface of floor cleaning head 112 and cleaning pad support 128. Lip 316 is partially supported by ribs 318 in the embodiment illustrated in FIG. 3*a*.

A cleaning pad support is not required in some embodiments. For example, a steam pad or other cleaning pad may be directly attachable to a floor cleaning head. A silicone pad or other structure may be positioned on an upper surface of the cleaning pad and configured to seal the suction opening when the cleaning pad is attached to floor cleaning head. Magnets, hook and loop fastener arrangements, or other attachment arrangements may be used to directly attach the pad to the floor cleaning head. In embodiments where a cleaning pad is attached directly to the floor cleaning head 112, magnets may be held by the pad as part of a control arrangement that switches modes when the presence of a cleaning pad is sensed.

Elements may be provided on cleaning pad support 128 to help maintain contact between the cleaning pad and cleaning pad support 128, and between the cleaning pad and the surface to be cleaned. For example, as may be seen in FIG. 5, walls 404 of cleaning pad support 128 protrude downwardly from the body of cleaning pad support 128. On rough or bumpy floor surfaces, walls 404 help to resist compression of the cleaning pad upwardly toward the body of cleaning pad support 128. By helping to maintain the cleaning pad in a generally planar configuration, walls 404 may facilitate a smooth passage of the cleaning pad across the surface to be cleaned.

Figure 6:
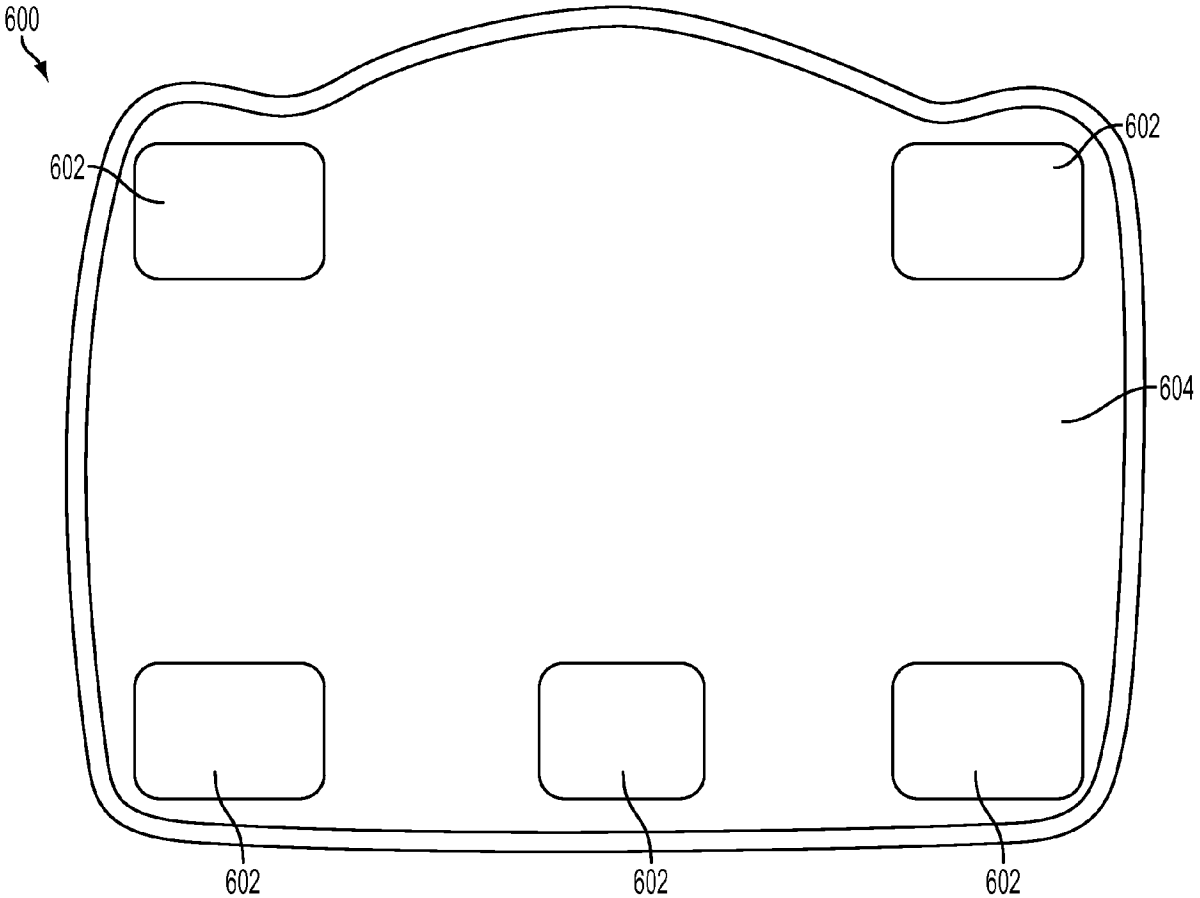
FIG. 6 is a top plan view of a pad that is attachable to the selectively removable attachment of FIG. 3*a;*

One embodiment of a steam pad 600 which may be used with embodiments herein is shown in FIG. 6. Steam pad 600 may be formed with any suitable steam-permeable fabric, for example, cotton or a synthetic fabric such as polyester or polyolefin fiber. A microfiber, such as a polyester microfiber may be used in some embodiments. A floor-contacting side (not shown) of steam pad 600 may have a smooth surface, a quilted surface, a shaggy material surface, a towel surface, or any other suitable surface texture.

Hook or loop fastener material areas 602 may be positioned at various locations on an upper surface 604 of steam pad 600. Areas 602 are positioned to correspond with attachment areas 408 of cleaning pad support 128 or floor cleaning head 112. It should be appreciated that other suitable arrangements for attaching steam pad 600 to cleaning pad support 128 or floor cleaning head 112 may be employed.

Figure 7:
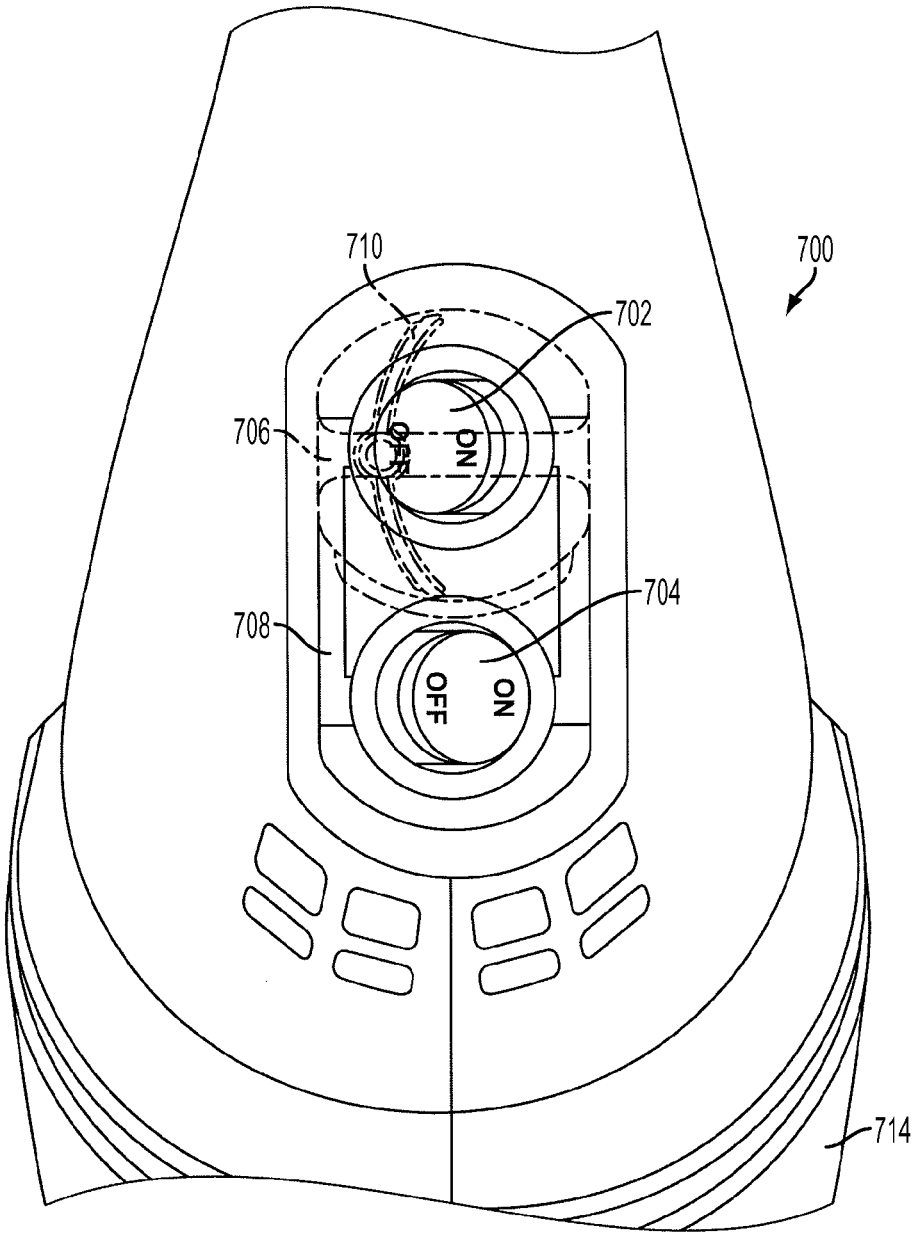
FIG. 7 shows a manual switching arrangement for selecting operation of one of two cleaning functions according to one embodiment of the invention.

Turning now to manual control of the functionality of cleaning appliance 100, a manual switching arrangement 700 is shown in FIG. 7. Switching arrangement 700 is one embodiment of a manual switching arrangement which prevents a user from simultaneously operating two cleaning function sources. For example, first and second cleaning function sources, such as a source to generate steam and a source to generate suction, may be operative upon energization. Manual on/off switches may be provided which energize the cleaning function sources, and various switch arrangements may be provided to control whether switches can be accessed and/or switched between modes.

Figure 8:
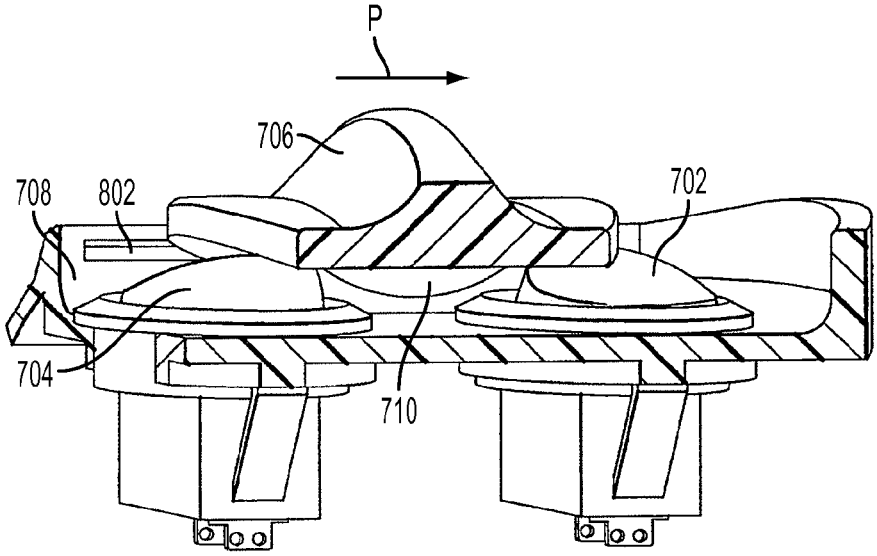
FIG. 8 shows a partial cross-sectional view of a manual switching arrangement according to one embodiment.

Switching arrangement 700 includes a steam on/off switch 702 and a vacuum on/off switch 704 positioned within a recess 708. A switch cover 706, shown in dashed lines in FIG. 7, is movable between a first position where switch cover 706 covers vacuum on/off switch 704 and a second position (the position shown in FIG. 7) where switch cover 706 covers steam on/off switch 702. In both the first and second switch cover positions, switch cover 706 prevents the user from accessing the on/off switch that is covered. Additionally, switch cover 706 includes a slanted member such as a ramp 710 which, when switch cover 706 is moved over one of the on/off switches, presses the on/off switch into the "off" position. For example, as illustrated in FIG. 8, when the user pushes switch cover 706 in the direction of arrow P, ramp 710 will push on/off switch 702 from the "on" position, which is the position of on/off switch 702 shown in FIG. 8, to the "off" position. Similarly, if vacuum on/off switch 704 is manually pressed to be in the "on" position while switch cover 706 is positioned over steam on/off switch 702, moving cover 706 back over the vacuum on/off switch will force vacuum on/off switch 704 into the "off" position. In this manner, whenever one on/off switch is initially exposed, both on/off switches will be in their "off" positions until the user presses the exposed switch into the "on" position. Because the covered on/off switch cannot be accessed by the user and the covered on/off switch is necessarily in the "off" position, the user cannot turn both switches to their "on" positions simultaneously.

While manual switching arrangement 700 is shown on the front of cleaning appliance 100 toward a top of a component housing 714, switching arrangement 700 may be positioned at any suitable location on cleaning appliance 100.

Figure 9:
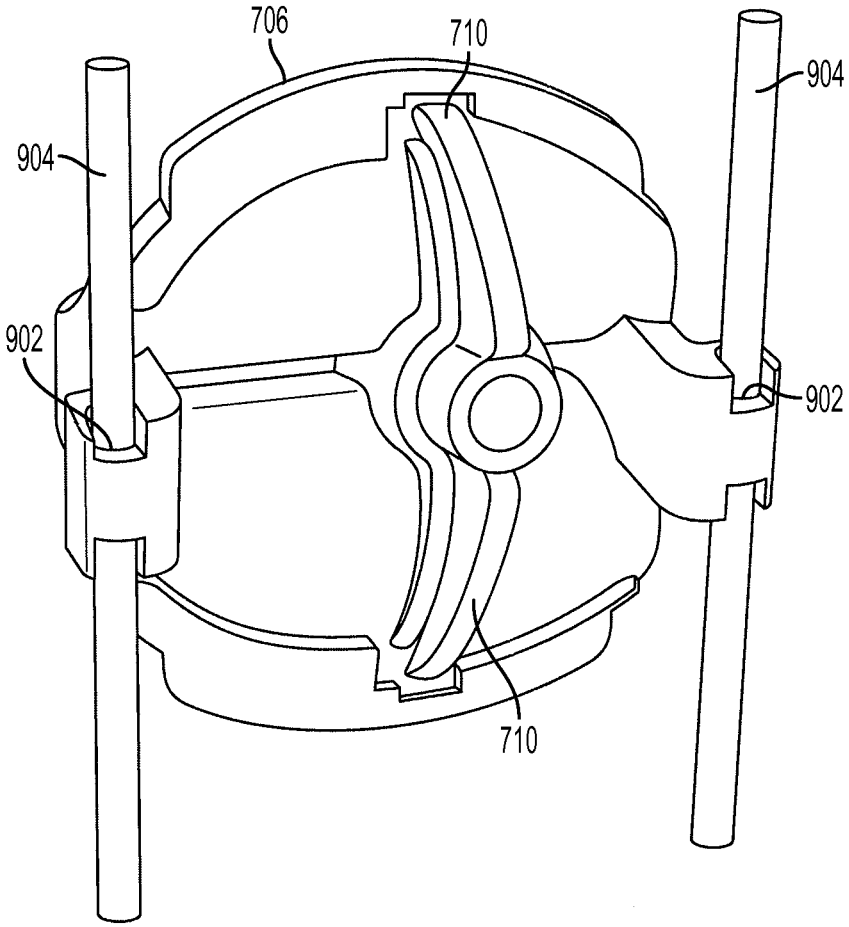
FIG. 9 is a bottom view of a switch cover according to one embodiment.
Figure 10:
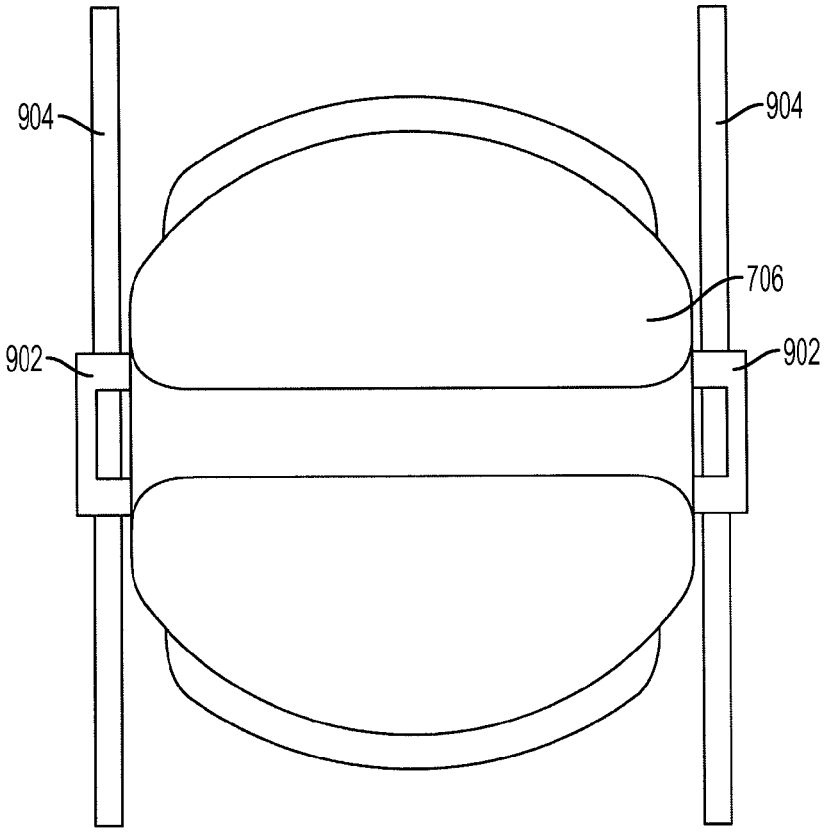
FIG. 10 is a top plan view of the switch cover of FIG. 9.

Switch cover 706 may be constructed and arranged to be slidable in any suitable manner. As shown in FIGS. 9 and 10, a bottom of switch cover 706 may have two short channels 902 which slide over two rails 904. In other embodiments, switch cover 706 includes tongues along its sides, and the tongues slide within grooves positioned along recess 708, such as a groove 802 shown in FIG. 8.

Other manual switching arrangements may be used which prevent simultaneous actuation and/or operation of two or more cleaning modes in the cleaning appliance. For example, instead of separate manual on/off switches for steam and vacuum, a single manual switch having three or more positions may be used. A first position may activate the steam function, a second position may activate the vacuum function, and a third position may turn off both functions. Time delay circuitry may be employed to prevent a rapid change from one function to another and/or to prevent rapid cycling. In some embodiments of cleaning appliances incorporating aspects disclosed herein, simultaneous actuation and/or operation of two or more cleaning functions may be permitted.

In some embodiments including a steam cleaning functionality, an "off" mode for steam cleaning may keep a steam generator energized in a standby mode. For example, a steam boiler may be operated at a reduced power, for example at 50% of the power level at which the boiler is operated when fully energized. Or, a boiler thermostat setting may be reduced such that boiler cycles on less frequently, but maintains a temperature above ambient temperature.

A controller for the various functionalities within the cleaning appliance may include a microprocessor, electronics disposed on a printed circuit board, integrated or discrete components, and/or application-specific hardware.

The vacuum cleaning function of certain cleaning appliance embodiments disclosed herein is exemplified as including an upright vacuum cleaner. Any of the appliances disclosed herein may contain one or more cyclonic cleaning stages and/or additional filtration stages, such as physical filter elements. It will be appreciated that the surface cleaning appliance may be of various configurations (e.g., a canister vacuum cleaner, a hand held vacuum cleaner, a back-pack vacuum cleaner and the like). It will also be appreciated that the cyclone and shroud construction disclosed herein may be used as a first stage cleaning step. However, in other embodiments, additional air treatment members may be provided upstream and/or downstream of the cyclone. It will be appreciated that the cyclone chamber and the dirt collection chamber may be in any orientation. In some embodiments, the air inlet of the cyclone chamber is below the opposed end of the cyclone chamber during use. Accordingly, for convenience, the air inlet end of the cyclone chamber and the portion of the dirt collection chamber in which the dirt collects may be referred to as the lower end and the opposed ends may be referred to as the upper ends.

Figure 11:
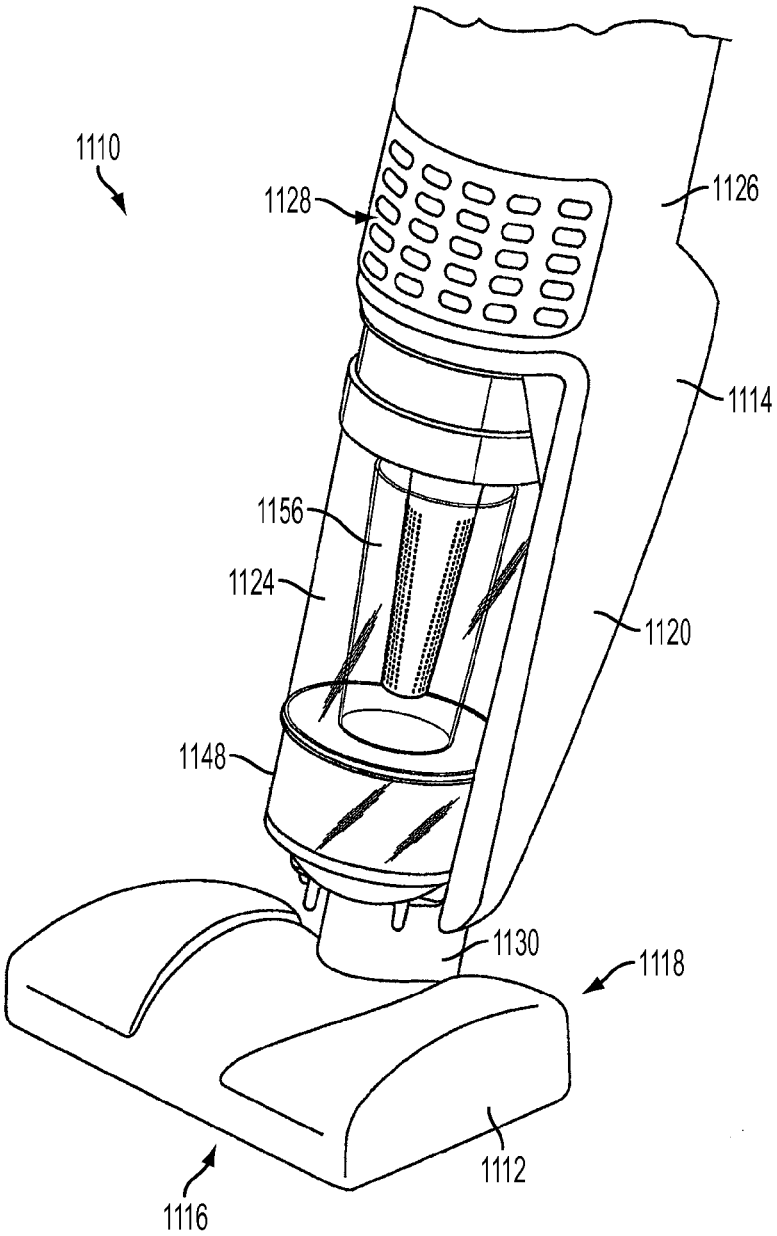
FIG. 11 is a front perspective view of a portion of an upright cleaning appliance.

Referring to FIG. 11, a cleaning appliance 1110 includes a floor cleaning head 1112 and an upright section 1114 pivotally mounted to floor cleaning head 1112. As exemplified, floor cleaning head has a front end 1116 and a rear end 1118. A suction opening is provided in the lower surface of floor cleaning head 1112. Floor cleaning head 1112 may include a brush member, such as a rotating brush as is known in the art. Wheels, glide members or other conveyance members may be provided to permit floor cleaning head 1112 to travel over the floor that is to be cleaned.

Upright section 1114 is pivotally mounted to floor cleaning head 1112. As illustrated, upright section 1114 includes a housing 1120 having a recess 1122 in which cyclone unit 1124 is removable mounted. When mounted in recess 1122, cyclone unit 1124 forms part of the air flow path through cleaning appliance 1110.

As exemplified, upright section 1114 includes motor housing 1126 positioned above recess 1122. An air exit grill 1128 is provided immediately above recess 1122 and provides the clean air outlet for cleaning appliance 1110. It will be appreciated that the suction motor may be provided at any location in cleaning appliance 1110 (it may be upright section 1114 or it may be in floor cleaning head 1112 as known in the art). Accordingly, the air flow path from the suction opening to the clean air outlet may be of various configurations. Further, a handle for driving the cleaning head may be provided on upright section 1114 or floor cleaning head 1112 as is known in the art (not shown).

Figure 12:
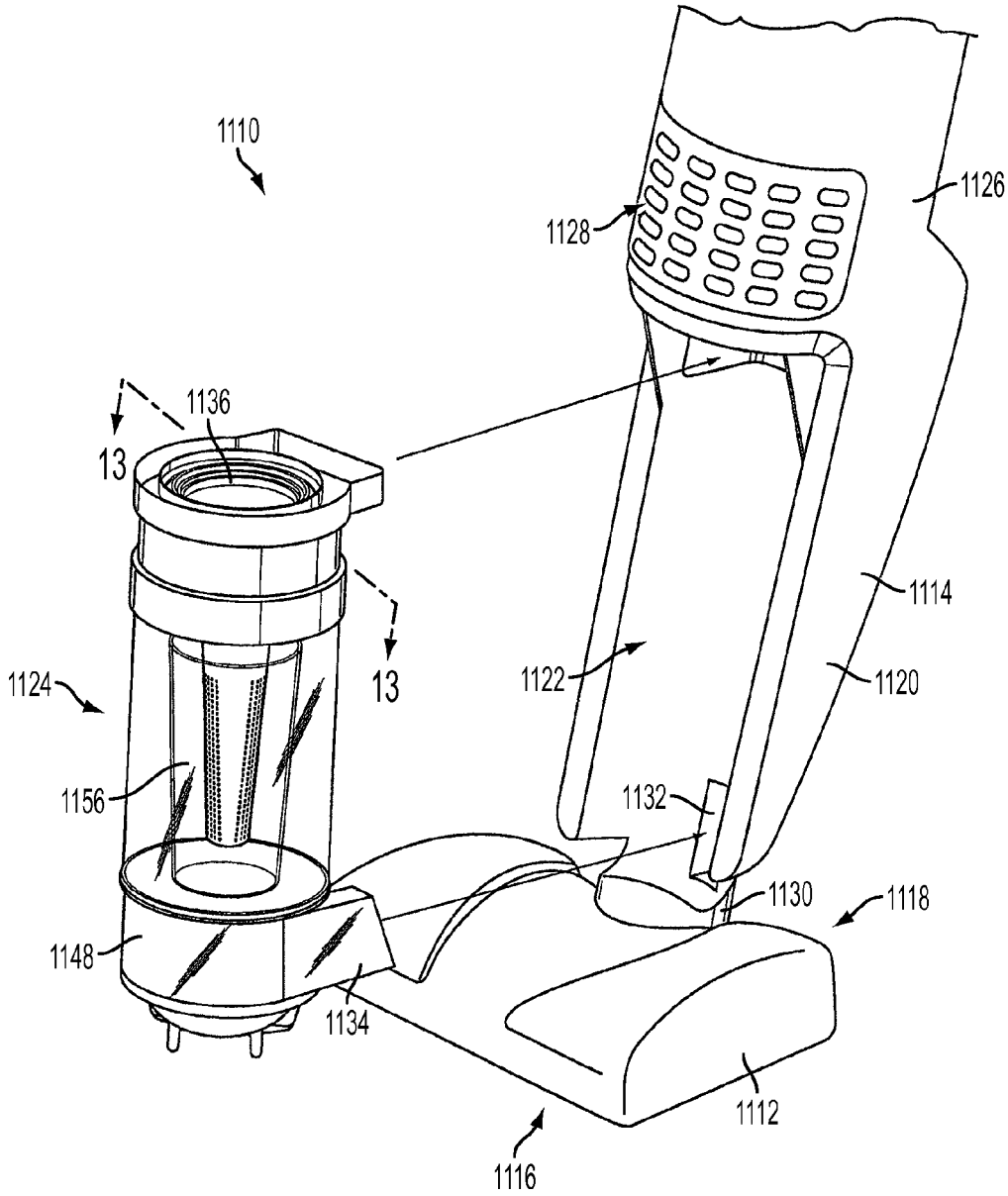
FIG. 12 is an exploded view of the cleaning appliance of FIG. 11 where the cyclone unit has been removed from the upright section of the cleaning appliance.

Referring to FIG. 12, air travels through floor cleaning head 1112, upwardly through an air flow conduit which may be in bottom 1130 of upright section 1114, and exits housing 1114 at air outlet 1132. Once cyclone unit 1124 is inserted into recess 1122, cyclone unit air inlet 1134 is in fluid communication with outlet 1132. In addition, when cyclone unit 1124 is inserted into recess 1122, cyclone unit air outlet 1136 is in air flow communication with housing 1114 and in particular with the air flow passage extending through housing 1114 to the suction motor in motor housing 26. It will be appreciated that cyclone unit air inlet 1134 and cyclone unit air outlet 1136 may be provided at various locations in cyclone unit 1124. For example, cyclone unit air inlet may be axially oriented and cyclone unit air outlet 1136 may be at an angle to the longitudinal axis of cyclone chamber 56.

Figure 13:
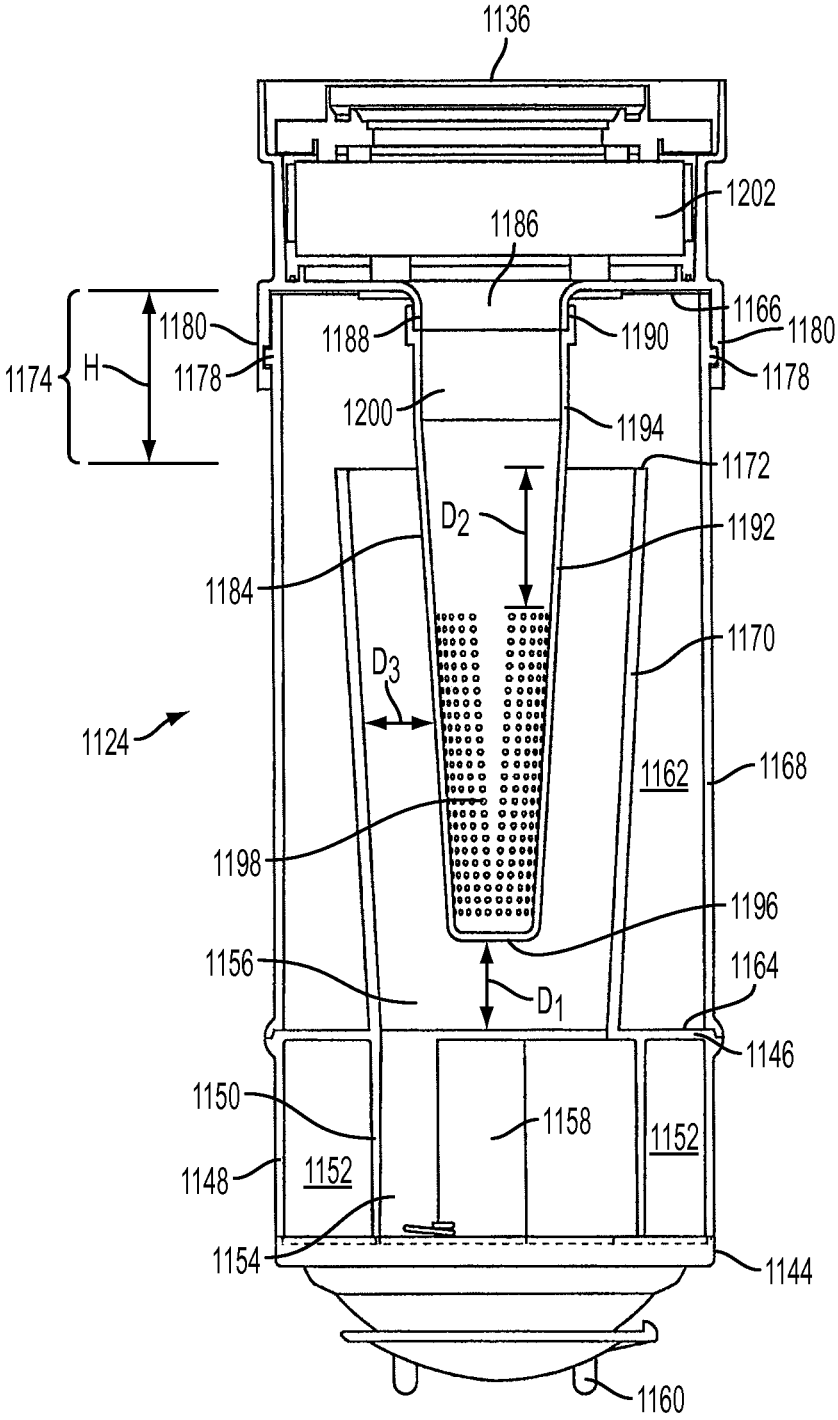
FIG. 13 is a cross-section along the line 13-13 in FIG. 12.
Figure 14:
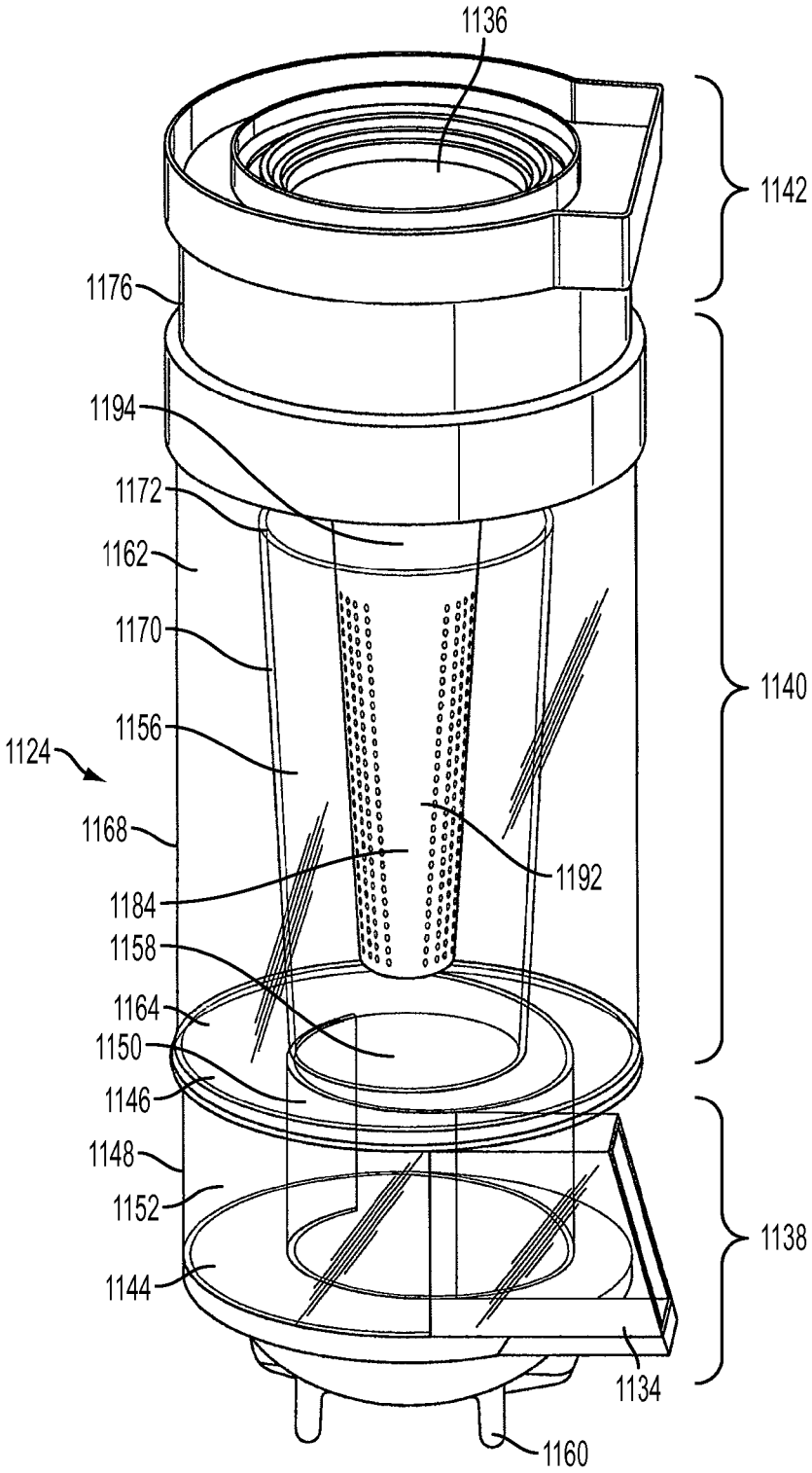
FIG. 14 is a perspective view of the cyclone unit of FIG. 13.

The cyclone chamber and dirt collection chamber construction exemplified in FIGS. 13-15 will now be discussed. It will be appreciated that the cyclone chamber and dirt collection chamber construction is exemplified in removable cyclone unit 1124. In an alternate embodiment, the dirt collection chamber and cyclone chamber need not be removed from cleaning appliance 1110 as a sealed unit for emptying. For example, the cyclone chamber and dirt collection chamber may be removable downwardly from upright section 1114 and the lid of these chambers may remain in position in upright section 1114.

As exemplified therein, cyclone unit 1124 comprises a lower air inlet section 1138, a cyclone section 1140 and an upper filter section 1142. Cyclone unit air inlet 1134 is provided on air inlet section 1138. Cyclone unit air inlet 1134 extends to air inlet chamber 1152 which is defined between lower wall 1144 of air inlet section 1138, lower wall 1146 of cyclone section 1140, outer wall 1138 and inner wall 1150. As shown in FIG. 14, air inlet chamber 1152 defines a curved or spiral chamber extending from the outlet of cyclone unit air inlet 1134 to air inlet end 1154 of cyclone chamber 1156. Air enters cyclone chamber 1156 at an opening 1158 provided in inner wall 1150.

As exemplified, air inlet section 1138 is provided with optional feet 1160 to assist cyclone unit 1124 properly seating in recess 1122.

Cyclone section 1140 comprises cyclone chamber 1156 and dirt collection chamber 1162. Referring to FIG. 13, cyclone chamber 1156 extends between lower wall 1164 and upper wall 1166 and is positioned between outer wall 1168 and cyclone chamber wall 1170. Accordingly, dirt collection chamber 1162 extends between first and second opposed ends, which, as exemplified, are defined by lower and upper walls 1164 and 1166. As exemplified, cyclone chamber 1156 is positioned wholly within dirt collection chamber 1162 and, preferably, centrally within dirt collection chamber 1162. Accordingly, it will be seen that in the illustrated embodiment dirt collection chamber 1162 comprises an annular space surrounding cyclone chamber 1156.

Cyclone chamber wall 1170 extends longitudinally from lower wall 1146 toward upper wall 1166 and terminates at a distance spaced therefrom. Accordingly, cyclone chamber wall 1170 has an end face 1172 that is spaced from and faces the second end of dirt collection chamber 1162 to define a gap 1174 having a height H. Gap 1174 accordingly defines the dirt outlet of cyclone chamber 1156. Height H may be from 1 cm to 6 cm in some embodiments, for example 3.5 cm.

Filter section 1142 comprises an optional openable lid 1176. Lid 1176 may be removably mounted to cyclone section 1140 by any means known in the art. For example, as exemplified in FIG. 13, outer wall 1168 may be provided with one or more ribs 1178 which are removably received in groves 1180 provided on inner wall 1182 of lid 1176. Accordingly, lid 1180 may be rotated and then moved away from cyclone section 1140.

Perforated shroud 1184 is provided on lid 1176 and is removably mounted to lid 1176. As exemplified, lid 1176 is provided with an opening 1186 in upper wall 1166. Descending wall 1188 is provided to define opening 1186. Shroud 1184 is provided with an upper collar 1190 which seats on descending wall 1188. It will be appreciated that shroud 1184 may be mounted to descending wall 1188 by any means known in the art, such as by a friction fit, bayonet mount, screw mount, welding an adhesive or the like.

As shroud 1184 is mounted to lid 1176, shroud 1184 has an upstream portion 1192 that is positioned in cyclone chamber 1156 and a downstream portion that is positioned between wall 1166 and end face 1172 (i.e., it is positioned exterior to cyclone chamber 1156).

Upstream portion 1192 of shroud 1184 is provided with a closed end 1196 and a plurality of perforations 1198. Closed end 1196 is preferably spaced from lower wall 1144 and, more preferably from air inlet end 1154 of cyclone chamber 1156 (i.e., it is positioned spaced upwardly form the plane defined by lower wall 1164 of dirt collection chamber 1162). Closed end 1196 is spaced a distance $D_1$ upwardly from the plane defined from lower wall 1164 of dirt collection chamber 1162. Distance $D_1$ may be any suitable distance, such as 1 cm, 1.8 cm, 3 cm, 5 cm or more.

Perforations 1198 are provided only on upstream section 1192 of shroud 1184 in some embodiments. Accordingly, downstream portion 1194 of shroud 1184 may have a continuous outer wall. Accordingly, the air exiting cyclone chamber 1156 enters longitudinal passage 1200 in the interior of shroud 1184 via perforations 1198, which comprise air exit passages from cyclone chamber 1156 into passage 1200.

Perforations 1198 may be provided in any pattern or arrangement and may be of any suitable size. The perforations all may be of the same size or may be of differing sizes. For example, the perforations may have diameters of 1 mm, 2 mm, 3 mm or more. In addition, the perforations may be provided on the entirety of upstream sections 1192 or only a portion thereof. For example, perforations 1198 may terminate a distance $D_2$ downwardly from end face 1172 of cyclone chamber wall 1170. Distance $D_2$ may vary from 0.5 cm to 5 cm. In some embodiments, perforations 1198 may terminate a distance upwardly from end face 1172.

At least one of shroud 1184 and cyclone chamber wall 1170 and, in some embodiments, both of shroud 1184 and cyclone chamber wall 1170 are tapered. As shown in FIG. 13, upstream portion 1192 of shroud 1184 tapers inwardly in the upstream direction (e.g., from downstream portion 1194 to closed end 1196). It will be appreciated that, optionally, downstream portion 1194 of shroud 1184 may also be tapered or, alternately, may have a constant diameter (e.g. it may be cylindrical). As exemplified, shroud 1184 transitions from a frustoconical tapered member to a conical member at a mid point of downstream portion 1194.

In addition cyclone chamber wall 1170 tapers outwardly in the downstream direction (e.g., from lower wall 1164 to end face 1172). Cyclone chamber wall 1170 may taper outwardly continuously along its length at a constant angle. Accordingly, cyclone chamber wall 1170 may be conical and increase in diameter towards the second end of dirt collection chamber 1162.

In some embodiments, the annular gap between shroud 1184 and dirt collection chamber 1170 has a distance $D_3$ transverse to the longitudinal axis of cyclone chamber. Distance $D_3$ may be generally constant along the length of upstream portion 1192 of shroud 1184. Accordingly, despite the shroud increasing in diameter in the downstream direction, the annular gap $D_3$ between the shroud and cyclone chamber wall 1170 need not necessarily decrease.

Lid 1176 may optionally comprise one or more filtration members, for example, two filters. For example, lid 1176 may be provided with a sponge filter 1202 and a thin filter (not shown) made of non-woven material, both downstream from opening 1186. The air travels through filter 1202 and the non-woven material filter and exits lid 1176 via outlet 1136.

Figure 15:
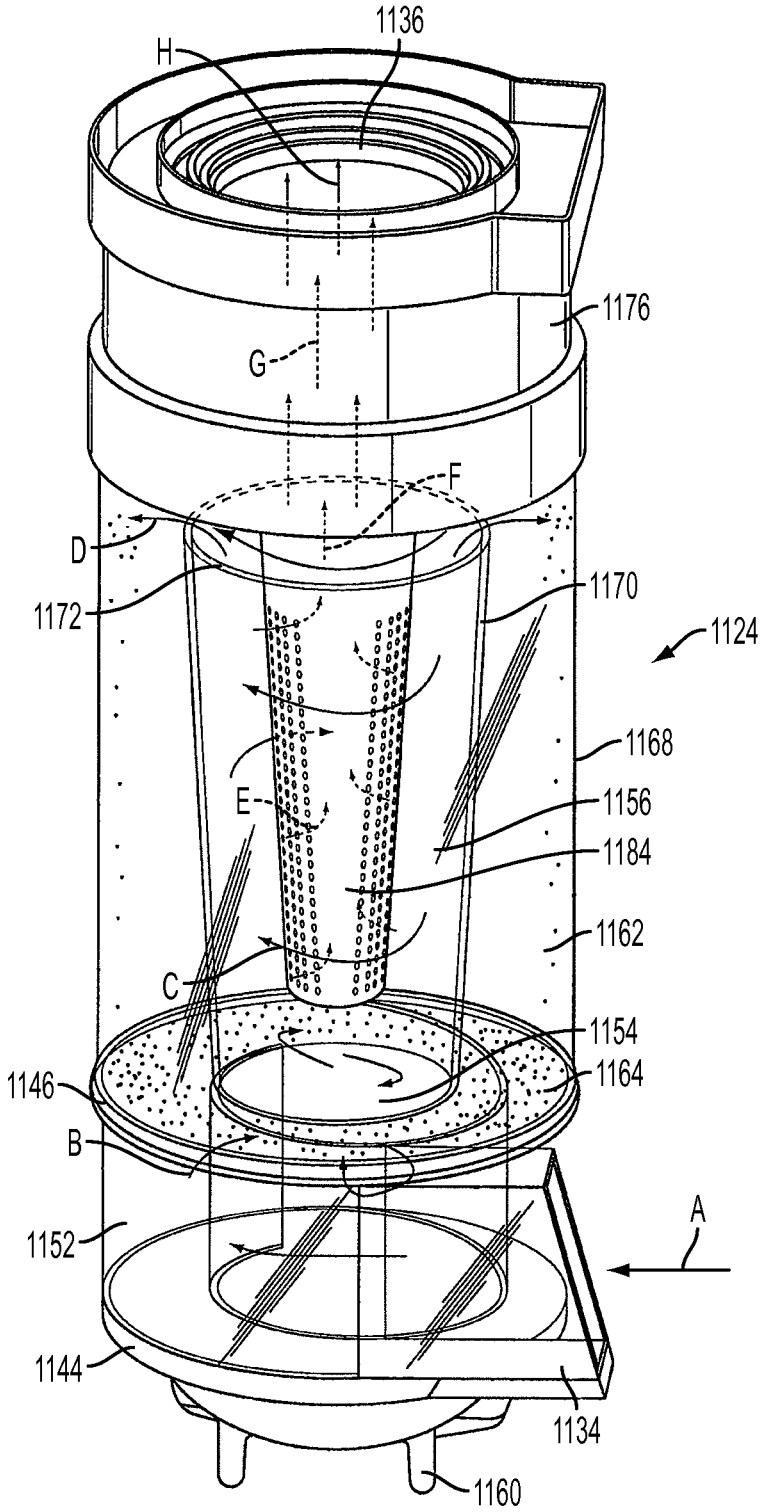
FIG. 15 is a schematic air flow diagram of the air flow through the cyclone unit.

A schematic air flow diagram is shown in FIG. 15. As exemplified therein, the air enters cyclone unit 1124 via inlet 1134 (arrow A). The air travels through air inlet chamber 1152 wherein it commences to travel in a rotational direction (arrow B). The air enters the inlet end 1154 of cyclone chamber 1156 wherein the air swirls upwardly in a cyclonic fashion (arrow C). The dirt is conveyed upwardly and exits cyclone chamber 1156 via outlet 1174 (arrow D). The separated material falls downwardly to lower wall 1164 of dirt collection chamber 1162. The air travels inwardly through perforations 1198 into longitudinal passage 1200 of shroud 1184 (arrow E). The air travels longitudinally through passage 1200 of shroud 1184 (arrow F), through filter 1202 (arrow G) and exits outlet 1136 (arrow H).

When it is desired to empty dirt collection chamber 1162, cyclone unit 24 may be removed from cleaning appliance 1110 and lid 1176 removed. The remaining portion of cyclone unit 1124 may then be inverted so that any material collected in dirt collection chamber 1162 may be emptied.

Figure 16:
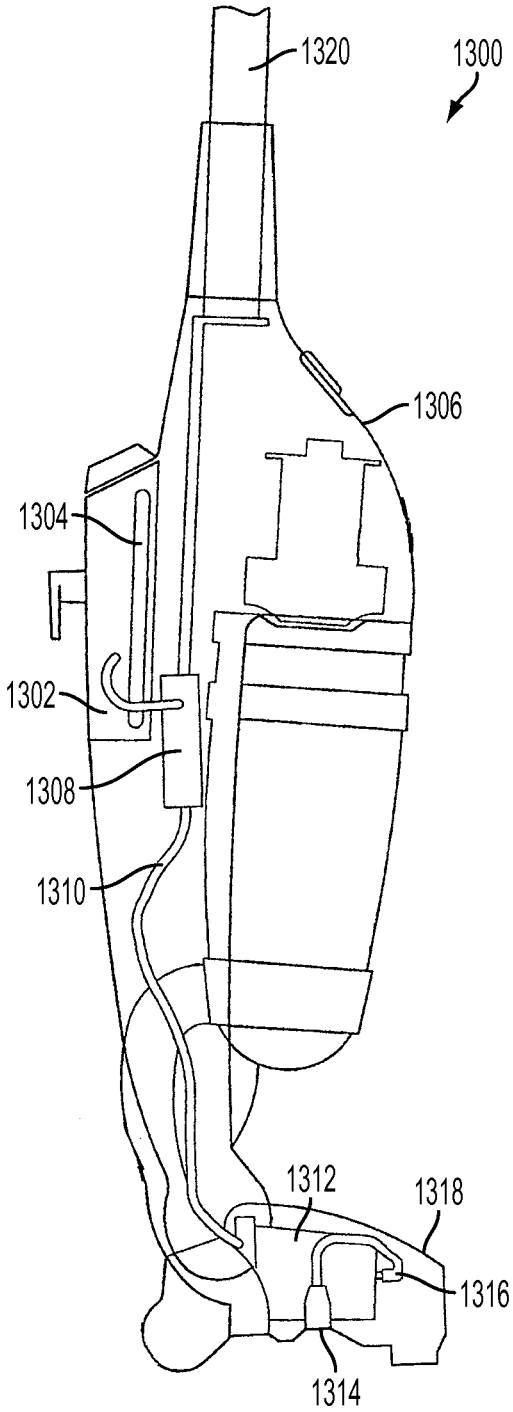
FIG. 16 is a partial cross-sectional side view of a cleaning appliance showing components of a steam cleaner.

The steam cleaning function of certain cleaning appliance embodiments disclosed herein is exemplified as including an upright steam cleaner 1300. The components and component arrangements described with regard to the embodiment of FIG. 16 are for illustration purposes only, as various components and component arrangements may be used. A reservoir 1302 including a view level window 1304 is positioned on a rear side of a component housing 1306. A liquid pump, such as an electric water pump 1308, is configured to pump water though a water conduit 1310 to a steam generator, such as a boiler 1312. Boiler 1312 is connected to a steam outlet 1314 via a steam conduit 1316. Boiler 1312 is positioned on one side of a floor cleaning head 1318 in this embodiment, but boiler 1312 may be positioned at any suitable location within floor cleaning head 1318, component housing 1306, or any other location within cleaning appliance 1300.

In some embodiments, instead of electric water pump 1308, a manually actuable pump may be used to move water from reservoir 1302 to boiler 1312. In such embodiments, the pump may be configured such that movement of a handle 1320 during pushing and pulling of cleaning appliance 1300 actuates the pump. In this manner, the user's motion in moving the cleaning appliance across the floor actuates the pump. A selectively actuable pump lock may be used to prevent operation of a manual pump in some embodiments.

A tilt switch is included in some embodiments as part of controlling the generation of steam. For example, a tilt switch may be positioned within the upright portion of the cleaning appliance and be configured to stop steam generation when the upright portion is oriented substantially vertically. When the upright portion is angled downwardly relative to the cleaning head, that is, when the handle is grasped by the user and tilted for pushing and pulling, the tilt switch changes modes and steam generation is permitted, subject to other control constraints. The tilt switch may have a time delay to prevent rapid on/off cycling due to temporary changes in orientation and/or momentum changes which cause the tilt switch to register a change in tilt. A roll ball tilt switch may be employed, and the tilt switch may be positioned on a printed circuit board within the cleaning appliance, although any suitable type of tilt switch and tilt switch positioning may be used.

Figure 17:
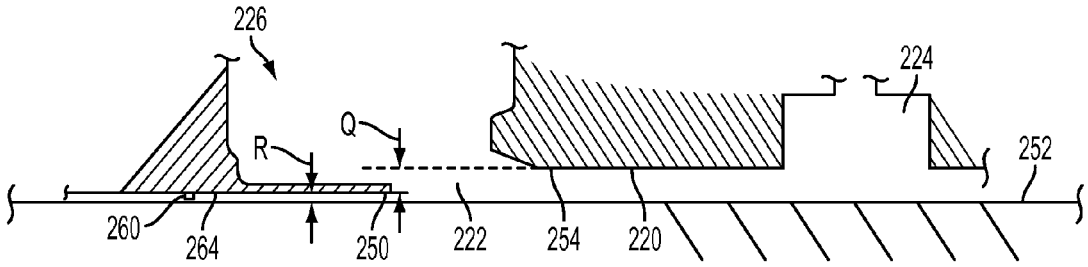
FIG. 17 is a cross-sectional side view of a lowered rear edge of a suction opening according to one embodiment.

According to another aspect of the invention, a perimeter of a suction opening may have a lowered rear edge. A lowered rear edge may enhance the pickup of particles by preventing the particles from passing by the suction opening. For example, as shown in FIG. 17, suction opening 222 has a rear edge 250 that extends downwardly by a distance Q from the recessed surface 220 of the floor-facing surface of floor cleaning head 112. Distance Q is approximately 4 mm in some embodiments, although other distances may be used, such as distance between 1 mm and 8 mm or distances between 2 mm and 5 mm. This lowered rear edge provides a clearance distance R of approximately 1 mm between suction outlet rear edge 250 and floor 252 in some embodiments. By contrast, a front edge 254 of suction opening 222 does not extend downwardly from recessed surface 220. As floor cleaning head 112 is moved forward across the floor, particles larger than clearance R are prevented from passing by suction opening 222. In the illustrated embodiment, suction opening 222 having lowered rear edge 250 is positioned on the interior of the floor-facing surface, that is, suction opening 222 is surrounded by the floor-facing surface rather than being positioned at a leading edge of floor cleaning head 112. Lowered rear edge 250 may extend to be at an even level with the portions of floor-facing surface 120 which do not include suction channels 204, or lowered rear edge may extend closer to the floor than floor-facing surface 120.

A downwardly extending ridge 260 may be provided at the rear of floor-facing surface 120. Similar to lowered rear edge 250, ridge 260 may help prevent particles from passing by floor cleaning head 112 without being suctioned into suction outlet 222 as the floor cleaning head 112 is moved in a forward direction. Ridge 260 extends downwardly from a rear portion 264 floor-facing surface 120 by approximately 1 mm in some embodiments, although any suitable size may be used. Ridge 260 may extend transversely to a direction of motion of the cleaning appliance, or may extend perpendicularly in some embodiments. For example, if cleaning appliance is configured to primarily travel in the forward and rear directions, ridge 260 may be positioned to extend side-to-side on the cleaning head. In some embodiments, portions of ridge 260 may be oriented at different angles relative to the cleaning head than other portions of ridge 260. Ridge 260 may extend across the entire width of floor-facing surface 120 at rear end 118 of floor cleaning head 112, as shown in FIG. 2, or ridge 260 may extend across only portions of floor-facing surface 120. In some embodiments, multiple ridges may be used.

Figure 18:
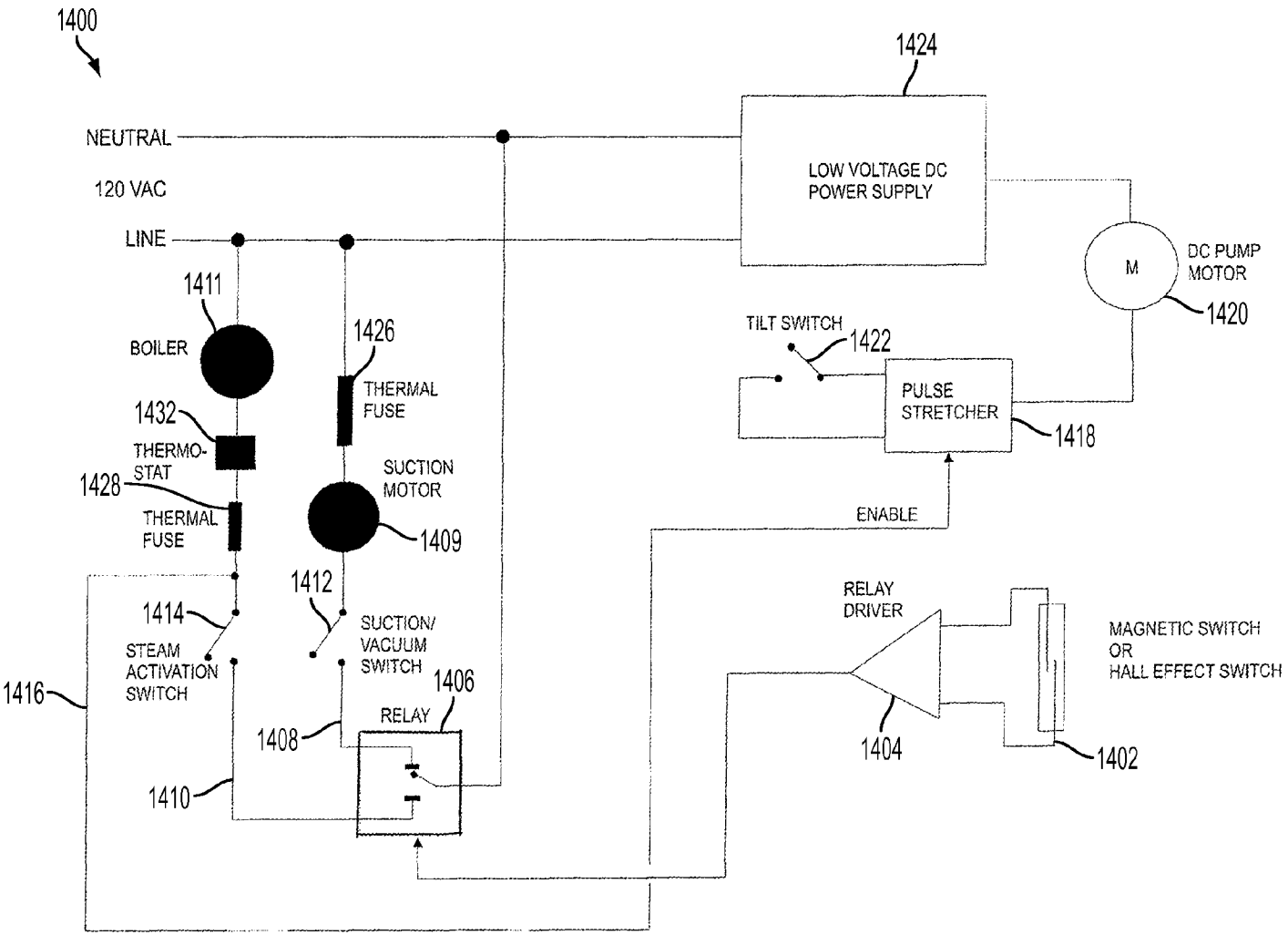
FIG. 18 is a schematic diagram of one embodiment of a switch and functional component arrangement.

FIG. 18 is a schematic diagram of one embodiment of a switch and functional component arrangement 1400 for control of a cleaning appliance having steam cleaning and vacuuming functionality. A switch 1402 is located at a position to sense an element in a pad support or a pad. Switch 1402 may be a magnetic switch, such as a reed switch, a hall effect switch, or any other suitable switch. A relay driver 1404 drives a relay 1406 based on switch 1402. If switch 1402 does not sense an element, relay 1406 connects to a suction line 1408, thereby providing 120 VAC power to suction line 1408 including a suction motor 1409, whereas if switch 1402 senses an element, relay 1406 connects to a boiler line 1410 to provide power to boiler line 1410 including a boiler 1411. Each line includes an activation switch 1412, 1414, which may include a manual switch. If steam activation switch 1414 is closed, a feedback enable signal is sent via a line 1416 to a pulse stretcher 1418 so that a pump motor 1420 for pumping water can be operated. A tilt switch 1422 may be employed such that pump motor 1420 only operates when a handle or upright portion of the cleaning appliance is angled. Pulse stretcher prevents rapid cycling of pump motor 1420 if tilt switch 1422 changes its signal rapidly. In some embodiments, pulse stretcher 1418 prevents pump motor 1420 from changing modes more than once every three seconds. A low voltage DC power supply 1424 may be used to power pump motor 1420. Each of suction line 1408 and steam line 1410 includes a thermal fuse 1426, 1428. Boiler 1430, such as a flash boiler, is controlled by a thermostat 1432.

A storage component for holding the cleaning pad and/or the cleaning pad support may be included as part of a cleaning appliance system. The storage component may be attachable to a pole that extends from the user handle. A post, a hook, or other device may be provided to hold the cleaning pad support. The cleaning pad may be rolled or folded and placed in an open or closed tube.

For purposes herein, the term "floor" is meant to include various types of floors, such as hardwood floors, linoleum floors, carpets, and any other floor surface amenable to cleaning. It should be appreciated that aspects of the embodiments disclosed herein may be employed on cleaning appliances which are capable of cleaning surfaces other than floors, such as countertops, walls, ceilings, oven hoods, or other surfaces.

For purposes herein, the terms "connect", "connected", "connection", "attach", "attached" and "attachment" refer to direct connections and attachments, indirect connections and attachments, and operative connections and attachments.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A cleaning appliance capable of performing at least two different cleaning functions, comprising:

a housing;

a cleaning head;

a component selectively attachable to the cleaning appliance, a controller configured to control operation of a first cleaning function and a second cleaning function in response to at least one of a switch and a sensor in the cleaning appliance; and wherein when the selectively attachable component is not attached to the cleaning appliance, the at least one switch or sensor allows the controller to be capable of operating the cleaning appliance to perform the first cleaning function, and when the selectively attachable component is attached to the cleaning appliance, the at least one switch or sensor allows the controller to be capable of operating the cleaning appliance to perform the second cleaning function and the controller cannot operate the cleaning appliance to perform the first cleaning function and wherein the first cleaning function comprises vacuuming and the second cleaning function comprises steam application.

2. A cleaning appliance as in claim 1, wherein when the selectively attachable component is not attached to the cleaning appliance, the controller cannot operate the cleaning appliance to perform the second cleaning function.

3. A cleaning appliance as in claim 1, further comprising a source to generate steam.

4. A cleaning appliance as in claim 3, further comprising a source to generate suction.

5. A cleaning appliance as in claim 1, wherein the selectively attachable component comprises a cleaning pad support.

6. A cleaning appliance as in claim 1, wherein the cleaning head includes a magnetic reed switch.

7. A cleaning appliance as in claim 1, wherein the selectively attachable component includes a magnet.

8. A cleaning appliance as in claim 7, wherein the magnet at least partially operatively connects the selectively attachable component to the cleaning head.

9. A cleaning appliance as in claim 1, wherein the cleaning head includes a hall effect sensor.

* * * * *